US011319752B2

(12) United States Patent
McMillan

(10) Patent No.: US 11,319,752 B2
(45) Date of Patent: May 3, 2022

(54) PERCUSSION DEVICE

(71) Applicant: Jaron Lyell McMillan, Christchurch (NZ)

(72) Inventor: Jaron Lyell McMillan, Christchurch (NZ)

( * ) Notice: Subject to any disclaimer, the term of this patent is extended or adjusted under 35 U.S.C. 154(b) by 0 days.

(21) Appl. No.: 17/266,272

(22) PCT Filed: Aug. 6, 2019

(86) PCT No.: PCT/IB2019/056662

§ 371 (c)(1),
(2) Date: Feb. 5, 2021

(87) PCT Pub. No.: WO2020/031075

PCT Pub. Date: Feb. 13, 2020

(65) Prior Publication Data

US 2021/0301593 A1 Sep. 30, 2021

(30) Foreign Application Priority Data

Aug. 7, 2018 (NZ) ..... 745010

(51) Int. Cl.

| | |
|---|---|
| ***B25D 16/00*** | (2006.01) |
| ***E21B 1/14*** | (2006.01) |
| ***E02D 7/06*** | (2006.01) |
| ***E02D 7/24*** | (2006.01) |
| *E21B 6/04* | (2006.01) |
| *E21B 7/02* | (2006.01) |

(52) U.S. Cl.
CPC ..... *E21B 1/14* (2020.05); *E02D 7/06* (2013.01); *E02D 7/24* (2013.01); *E21B 6/04* (2013.01); *E21B 7/025* (2013.01)

(58) Field of Classification Search
CPC .... B25D 2216/0007; B25D 2216/0023; B25D 2216/0046; B25D 2216/0053
USPC ..... 173/93.5, 94, 104, 109
See application file for complete search history.

(56) References Cited

U.S. PATENT DOCUMENTS 1,347,973 A * 7/1920 Alexande ..... E02D 7/26 175/323
3,396,807 A 8/1968 Menton

FOREIGN PATENT DOCUMENTS

CN 204326969 U 5/2015
WO 2017056026 A1 4/2017

* cited by examiner

*Primary Examiner* — Sunil Singh
(74) *Attorney, Agent, or Firm* — Saliwanchik, Lloyd & Eisenschenk

(57) ABSTRACT

A percussion device including an input side and an output side, the input side is configured to be rotationally driven and the output side is rotationally driven by the input side via a drive transmitter/drive transmitter pathway combination, where the percussion device includes a percussion impactor, an impactor shaft and a percussion anvil; in use, where the output side has restricted, or no, ability to rotate, the drive transmitter/drive transmitter pathway combination increases the distance between the percussion impactor and the percussion anvil until the drive transmitter/drive transmitter pathway combination releases the percussion impactor, where the percussion impactor includes at least one impactor impact tooth and the percussion anvil includes at least one anvil impact tooth, wherein each impact tooth includes an angled impact surface, such that complementary impact surfaces are configured to pass a percussive and/or rotational impulse from the percussion impactor to the percussion anvil.

20 Claims, 19 Drawing Sheets

PERCUSSION DEVICE

CROSS REFERENCE TO RELATED APPLICATIONS

This application is a National Stage Application of International Application Number PCT/IB2019/056662, filed Aug. 6, 2019; which claims priority to New Zealand Application No. 745010, filed Aug. 7, 2018.

TECHNICAL FIELD

The present invention is a device that imparts a percussive force to a tool when that tool meets resistance to rotation, if the resistance continues this percussive force can be periodically applied. Specific applications include rock drills used to drill into the ground and small drills used to drill concrete and the like where variations in the material being drilled can slow or stall the drill; and pile drivers. In an alternative form the device incorporates a locking mechanism that forces the percussive device into a percussion only form.

BACKGROUND ART

When a drill is used to drill into rock it can meet material that can slow or stop that drill, to continue drilling the drill head can be backed off from the surface and whilst rotating the drill head pushed into contact in an attempt to clear the material to recommence the drilling operation. This takes time and does not always allow drilling to recommence, sometimes the drill needs to be withdrawn and a different drill head or drill used until the obstructive material is cleared or passed through. If the drill is rotating and it meets material that stops the drill's rotation quickly then damage to the drill head and/or drill string and/or drive unit may occur.

Conventional drilling is often used with non-impact, purely friction methods, this is, or can be, slow.

To overcome the requirement to withdraw the drill, or back the drill head off and back into contact, some drill strings incorporate a percussion unit to apply a periodic percussive force to the drill string or drill tip. These devices include percussion hammers driven by pneumatic or hydraulic systems these can be expensive to run, require an auxiliary source of energy to run the percussion, often via the drilling fluid medium. These devices often require compressed air which in some situations can be problematic. In addition, many of these percussion devices operate continuously or at a fixed rate once engaged; this may not be optimum in many situations. Often the drill head on a percussion hammer drill string is held on by one or more split rings, if these rings break the drill head can be lost, or at least difficult to recover.

For some subsurface operations it would be useful to apply a percussive force with some rotational impulse, however percussion hammers cannot do this.

Any discussion of the prior art throughout the specification is not an admission that such prior art is widely known or forms part of the common general knowledge in the field.

It is an object of the present invention to provide a solution to ameliorate one or more of the problems outlined above, or at least provide a consumer with a useful choice.

DISCLOSURE OF INVENTION

The present invention provides a percussion device including an input side and an output side, where the input side is configured to be rotationally driven and the output side is configured to be rotationally driven by the input side via a drive transmitter/drive transmitter pathway combination, where at least one drive transmitter is configured to slide or roll along at least part of a length of said drive transmitter pathway, such that the percussion device further includes a percussion impactor, an impactor shaft and a percussion anvil wherein:

- the impactor shaft is an elongate member extending from the output side towards the input side;
- the percussion impactor includes impactor shaft tunnel which is a longitudinally co-axially aligned void;
- the impactor shaft is a longitudinal sliding fit within the impactor shaft tunnel;
- the impactor shaft incorporates one or more impactor shaft spline which is a longitudinally aligned helical spline;
- the impactor shaft tunnel incorporates one or more impactor shaft tunnel which is longitudinally aligned helical channel in a wall of said impactor shaft tunnel; and
- the impactor shaft and percussion anvil are part of the output side;

such that in use, where the output side has restricted, or no, ability to rotate, the combination of the drive transmitter/drive transmitter pathway combination increases the distance between the percussion impactor and the percussion anvil as the interaction of the at least one impactor shaft channel within a complementary impactor shaft spline causes the percussion impactor to rotate in a direction counter to the input side until the drive transmitter/drive transmitter pathway combination releases the percussion impactor, characterised in that, the percussion impactor includes at least one impactor impact tooth and the percussion anvil includes at least one anvil impact tooth, wherein each impact tooth includes an angled impact surface, such that complementary impact surfaces are configured to pass a percussive and/or rotational impulse from the percussion impactor to the percussion anvil.

Preferably, in use, complementary impact surfaces cannot rotate completely past each other in the direction of rotation of the input side.

Preferably the helical twist in the impactor shaft spline is between $1/20^{th}$ and ¾ a turn. In a highly preferred form this is between $1/6^{th}$ and ½ of a turn.

Preferably the angle between the at least one impactor shaft spline and the impact surface is angle φ and preferably the angle φ is expected to be between 65° and 125°, more preferably between 80° and 100°. In a most preferably between 85° and 95°.

Preferably the impact surface on the at least one anvil tooth is an anvil impact surface and the impact surface on the at least one impactor impact tooth is an impactor impact surface.

Preferably complementary impact surfaces are parallel +/−10° to each other

Preferably the impactor shaft tunnel is made up of a plurality of impactor shaft modules within a module tunnel formed within the percussion impactor.

Preferably each impactor shaft module includes one or more module keys configured to engage with a module keyway within the module tunnel.

Preferably the plurality of impactor shaft modules is held in the module tunnel by a retention device. Alternatively, each impactor shaft module is independently held within the module tunnel by a separate retention device.

In an alternative form the present invention provides a percussion device including an input side and an output side, where the input side is configured to be rotationally driven and the output side is configured to be rotationally driven by the input side via a drive transmitter/drive transmitter pathway combination such that the percussion device further includes a percussion impactor, an impactor shaft and a percussion anvil wherein:

- the impactor shaft is an elongate member extending from the output side towards the input side;
- the percussion impactor includes impactor shaft tunnel which is a longitudinally co-axially aligned void;
- the impactor shaft is a longitudinal sliding fit within the impactor shaft tunnel;
- the impactor shaft incorporates one or more impactor shaft spline which is a longitudinally aligned helical or straight spline;
- the impactor shaft tunnel incorporates one or more impactor shaft tunnel which is longitudinally aligned helical or straight channel in a wall of said impactor shaft tunnel; and
- the impactor shaft and percussion anvil are part of the output side;

wherein in use, where the output side has restricted, or no, ability to rotate, the combination of the drive transmitter/drive transmitter pathway combination increases the distance between the percussion impactor and the percussion anvil as the interaction of the at least one impactor shaft channel within a complementary impactor shaft spline causes the percussion impactor to rotate in a direction counter to the input side until the drive transmitter/drive transmitter pathway combination releases the percussion impactor, such that at least one drive transmitter incorporates a magnet, a transmitter magnet, and said drive transmitter pathway includes at least one magnet, a pathway magnet, wherein like poles of the magnets are facing, the strength of said magnets is selected so that in normal use the drive transmitter is physically separated from the drive transmitter pathway by a magnetic biasing force between opposing magnets.

Preferably there are a plurality of pathway magnets spaced along a length of the drive transmitter pathway and the distance between the drive transmitter pathway and a terminal end, a force input end, of the impactor changes as you move along the length of the drive transmitter pathway.

In an alternative preferred form there are a plurality of pathway magnets spaced along a length of the transmitter pathway and the distance between the drive transmitter pathway and a terminal end of the impactor does not change as you move along the length of the transmitter pathway.

It is further preferred that at least one of the pathway magnets is embedded in a surface of the drive transmitter pathway.

Preferably at least some of the plurality of pathway magnets are tuned pathway magnets where each tuned pathway magnet has an independently selected, magnetic field strength, such that the magnetic field strength is selected to form at least a portion of the drive transmitter pathway without changing the physical distance between the tuned pathway magnets and the force input end of the impactor.

Preferably the magnets are permanent magnets made of at least one magnetic material independently selected from ferromagnetic and ferrimagnetic materials.

The present invention provides a percussion device including an input side and an output side, where the input side is configured to be rotationally driven and the output side is configured to be rotationally driven by the input side via a drive transmitter/drive transmitter pathway combination, where at least one drive transmitter is configured to slide or roll along at least part of a length of said drive transmitter pathway, such that the percussion device further includes a percussion impactor, an impactor shaft and a percussion anvil wherein:

- the impactor shaft is an elongate member extending from the output side towards the input side;
- the percussion impactor includes impactor shaft tunnel which is a longitudinally co-axially aligned void;
- the impactor shaft is a longitudinal sliding fit within the impactor shaft tunnel;
- the impactor shaft incorporates one or more impactor shaft spline which is a longitudinally aligned helical or straight spline;
- the impactor shaft tunnel incorporates one or more impactor shaft tunnel which is longitudinally aligned helical or straight channel in a wall of said impactor shaft tunnel; and
- the impactor shaft and percussion anvil are part of the output side;

such that in use, where the output side has restricted, or no, ability to rotate, the combination of the drive transmitter/drive transmitter pathway combination increases the distance between the percussion impactor and the percussion anvil until the drive transmitter/drive transmitter pathway combination releases the percussion impactor, characterised in that, the impactor includes a splined tunnel module and the impact shaft includes a splined sleeve, where the splined tunnel module includes the impactor shaft tunnel and the splined sleeve includes the at least one impactor shaft spline; such that the splined tunnel module is releasably but rigidly retained in the impactor and the splined sleeve is releasably but rigidly attached to an impactor shaft core which is part of the output side; said splined tunnel module and splined sleeve form a splined module set.

BRIEF DESCRIPTION OF DRAWINGS

By way of example only, a preferred embodiment of the present invention is described in detail below with reference to the accompanying drawings, in which:

FIG. 29 is a side view of a further variant of the percussion assembly with the drive transmission pathway made up of a plurality of separate spaced apart tooth sections with the spaces between.

DEFINITIONS

Figure 1A:
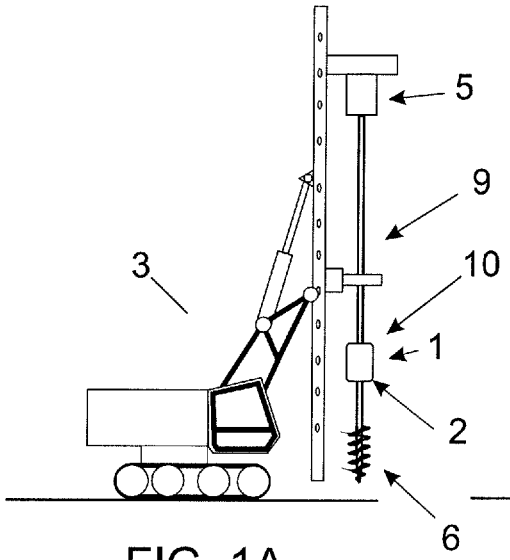
FIG. 1 is a series of 4 side views (A. to D.) of a drilling rig with the percussion device attached to drill or pile driver attached to a rig for a variety of uses.
Figure 1B:
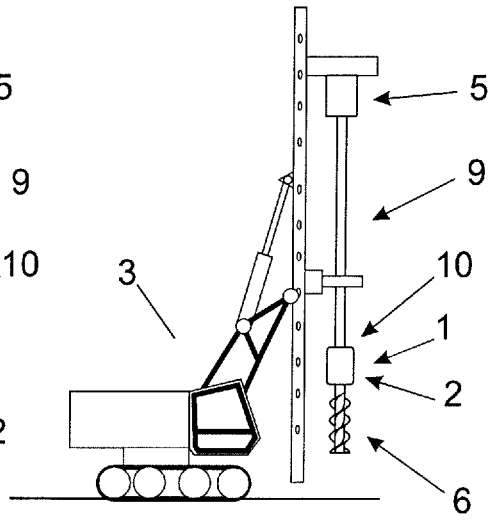
Figure 1C:
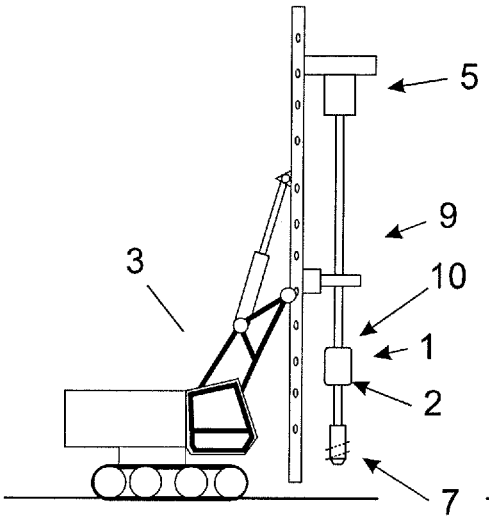
Figure 1D:
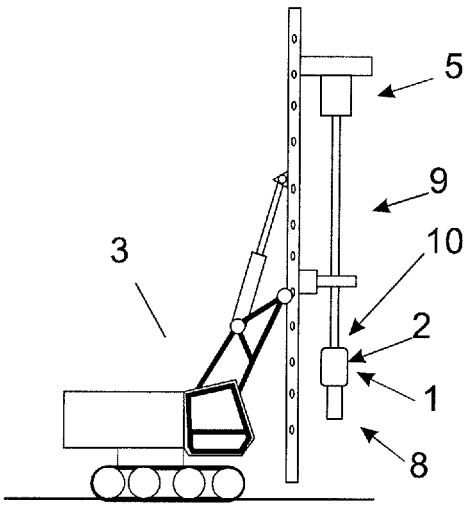

Sawtooth: is a waveform that has an inclined section extending from a base to an apex which drops abruptly to the base after the apex. This term is intended to cover waveforms that are similar to breaking surf or otherwise include an undercut section below the apex, as well as waveforms which have sharp or rounded apexes and curved or linear inclined sections.

Shaft: a thin long piece of rigid material that turns or is turned to pass on power or movement to another part, it may have any cross-sectional shape appropriate for the purpose, it may be hollow (tube like) or a solid material:

Please note that where a range is provided it is intended that any sub-range falling within that range is also specifically covered, for example a range of 2 to 20 covers all ranges defined by the formula x to y where x is selected from 2 to 20 and y is selected from x to 20; 0.05 Hz to 500 Hz covers all ranges defined by the formula a to b where a=0.05 to 500 Hz and b=a to 500 Hz. The interval depends on what the range covers, if the range covers the number of objects present then it is likely the smallest division is one object so a range of 1 to 10 would be 1, 2, 3, 4, 5, 6, 7, 8, 9 and 10; if the range was for example a frequency range then it includes fractional parts down to the limitations of measurement.

Please note that the drawings are representative only and some of the relative dimensions or relative scales differ from that present in the preferred or optimum versions, this is for clarity reasons.

ONE MODE FOR CARRYING OUT THE INVENTION

Referring to FIG. 1 a percussion device (1) with an outer casing (2) is shown attached to a variety of drilling or pile driving solutions A., B., C. and D. each including a rig (3) with a main drive unit (5). The main drive unit (5) is most likely a motor (electric or hydraulic) and gearbox (usually present but not always), but it can be a motor alone or any other suitable type of drive unit (fixed speed, variable speed, electric, hydraulic, with or without gearbox). FIG. 1 A. and FIG. 1 B. show standard drills (6), FIG. 1 C. shows a twin concentric drill (7) similar to that described in U.S. Pat. No. 9,115,477 and FIG. D. shows a pile driver (8) using the percussion device (1) rather than traditionally used devices. The drill bits shown in FIG. 1 are representative only they can be any known form of roller cutter or fixed cutter type of drill bit including but not limited to twin, tri, quad (or a plurality of these) roller cone bits, blade/scraper/drag bits, Polycrystalline Diamond Compact (PDC) bits, diamond bits, percussion bits or variants and combinations of these. In use the main drive unit (5) rotates the drill string (9) prior to an input side (10) of the percussion device (1), thus rotating the outer casing (2).

Figure 2:
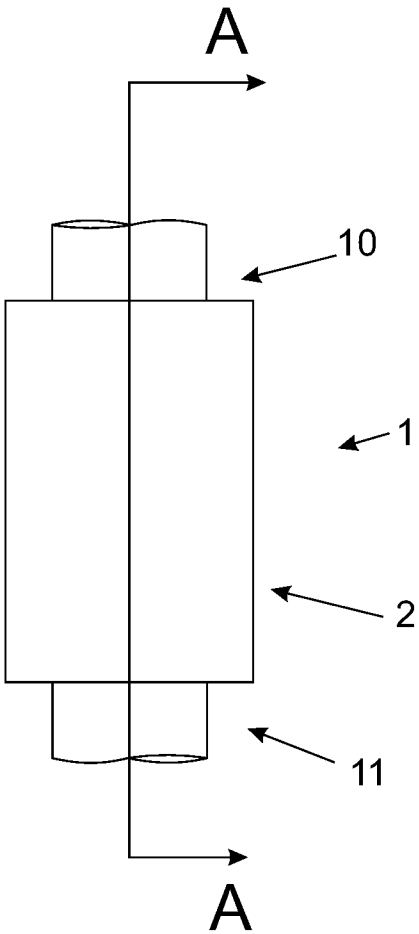
FIG. 2 is a side view of the percussion device.

Referring to FIG. 2 the percussion device (1) including an input side (10) and an output side (11) is shown with the outer casing (2) intact. In use the percussion device (1) translates the rotational motion applied directly or indirectly, to the input side (10) into percussive and/or rotational motion on the output side (11).

Figure 3:
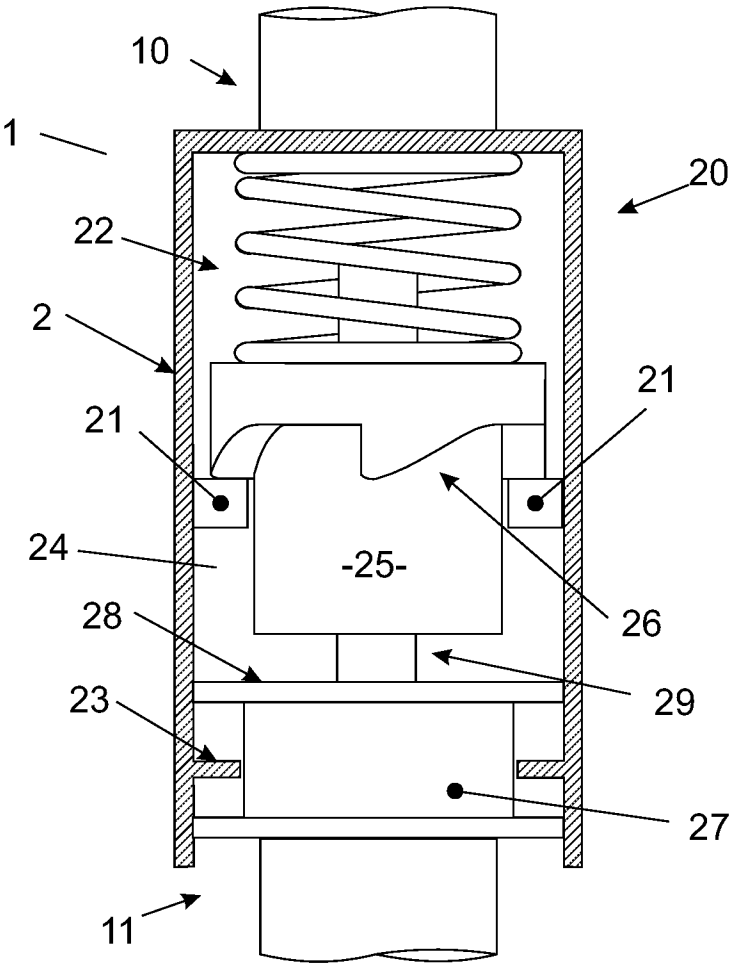
FIG. 3 is a cross sectional view, with the outer casing cut along the line A-A and viewed in the direction of arrows A-A, of the percussion device.

Referring to FIG. 3 a cross-sectional view of a first variant of the percussion device (1), with the outer casing (2) cut along the cut line A-A, viewed in the direction of arrows AA in FIG. 2, is shown. The percussion device (1) includes:

- an input assembly (20) including the outer casing (2), drive transmitters (21), a force unit (22) and an alpha section (23);
- a percussion assembly (24) including a percussion impactor (25) with a drive transmitter pathway (26); and
- an output assembly (27) including a percussion anvil (28) and an impactor shaft (29).

Where the input assembly (20) is located on the input side (10) of the percussion device (1) and the output assembly (27) is located on the output side (11) of the percussion device (1).

Figure 4:
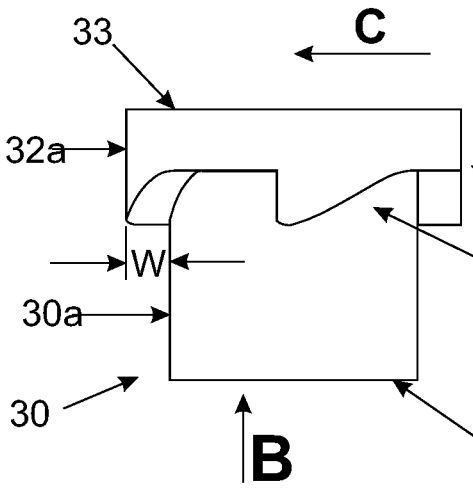
FIG. 4 is a side view of the percussion assembly separated from the percussion device.
Figure 5:
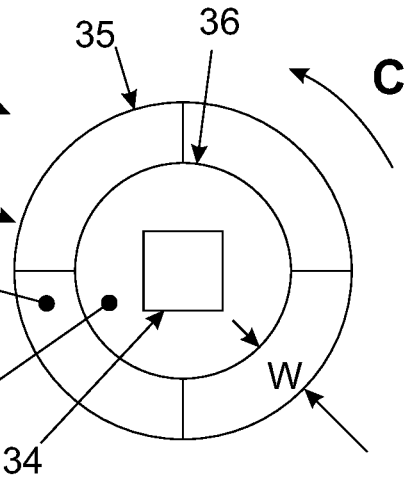
FIG. 5 is a view of the percussion impactor in the direction of the arrow B.

Referring to FIG. 4 and FIG. 5, where FIG. 5 is a view of the percussion impactor (25) in the direction of arrow B, the percussion impactor (25) is shown separated from the percussion device (1). The percussion impactor (25) includes:

- a first section (30) including an impact end (31);
- a pathway section (32) including a force input end (33), and
- an IS (Impactor Shaft) tunnel (34); where
- the impact end (31) and the force input end (33) are coterminous with the longitudinally opposite terminal ends of the percussion impactor (25); and
- the pathway section (32) includes the drive transmitter pathway (26).

The first section (30) includes a first section side surface (30*a*) (FS side surface (30*a*) for brevity) and the pathway section (32) includes a second section side surface (32*a*) (SS side surface (32*a*) for brevity). Where the side surfaces (35,36) are the exposed sides of the relevant section. The drive transmitter pathway (26) extends from the FS side surface (30*a*) to the SS side surface (32*a*) where the first section (30) and pathway section (32) are coterminous. The drive transmitter pathway (26) is a continuous path that encircles the percussion impactor (25). It is preferred, but, not necessarily, required, that the surface of the drive transmitter pathway (26), at any point along its path, lies on a plane perpendicular to the longitudinal axis of the percussion impactor (25).

The pathway section (32) is shown circular in cross-section with a diameter greater than the largest cross-sectional dimension of the first section (30). In this case the first section (30) is shown with a circular cross-section so the width (W) of the drive transmitter pathway (26) is constant around the percussion impactor (25) but, in some configurations, the cross-sectional shape of the first section (30) will not be circular (it may be polygonal or oval for example).

The IS tunnel (34) is an open-ended void aligned with the longitudinal axis of the percussion impactor (25), with apertures at each terminal end of the percussion impactor (25). The cross-sectional shape and dimensions of the IS tunnel (34) are such that when engaged with the impactor shaft (29) the percussion impactor (25) can slide along a portion of the length of the impactor shaft (29). The complementary cross-sectional shapes of the IS tunnel (34) and the impactor shaft (29) are such that there is minimal differential rotational motion between the percussion impactor (25) and the impactor shaft (29) when engaged. It is preferred that the percussion impactor (25) can freely slide along at least a portion of the length of the impactor shaft (29). In FIG. 5 the IS tunnel (34) is shown with a square or rectangular cross section.

The impact end (31), in this first variant, is a flat surface that lies on a plane perpendicular to the longitudinal axis of the percussion impactor (25).

The distance between the force input end (31) and the drive transmitter pathway (26) varies as you move along the length of the drive transmitter pathway (26). Moving along the drive transmitter pathway (26) in the direction of arrow C the distance between the force input end (31) and the drive transmitter pathway (26) increases then rapidly decreases and then remains the same until it increases again then rapidly decreases and then remains the same before repeating the pattern. The pathway waveform (75) (see FIGS. 10 and 17) is essentially a tooth with each tooth spaced apart. The number of rises for each full rotation of the percussion impactor (25) will vary but it is thought that it will be an even number (2 to 1000) and in use will result in a percussive frequency of between 0.1 to 150 Hz, though some applications may fall in the range of 0.05 Hz to 500 Hz.

The percussion impactor (25) is expected to be a dense rigid material, most likely metal and preferably one or more forms of steel. In this first variant the percussion impactor (25) is an essentially solid construction, but, it may, in certain configurations, include voids that can be filled with liquid materials to change the behaviour of the percussion impactor (25). For example, the void could be partially filled allowing the liquid to move or the mass of the percussion impactor (25) could be adjusted whilst in use by adding or removing liquid. If mercury was used then the mass would be greater than a steel percussion impactor (25); the density of mercury is 13.5 tonne/$m^3$ and the density of steel is about 7.8 tonne/$m^3$.

Figure 6:
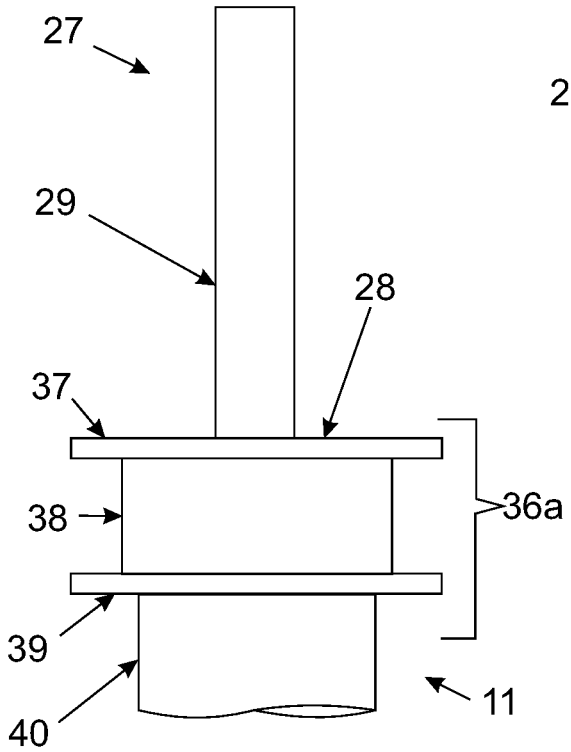
FIG. 6 is a side view of the output assembly shown removed from the percussion device.

Referring to FIG. 6 the output assembly (27) including the percussion anvil (28), the impactor shaft (29) and the isolation section (36*a*) is shown separated from the percussion device (1) is shown. The isolation section (36*a*) includes an isolation support (37) an isolator (38) and an isolation disc (39). The isolation support (37) and isolation disc (39) are separated by the isolator (38) forming an essentially T shaped section. The outside diameter of the isolation support (37) and isolation disc (39) in this first variant is the same (though it need not be). The outside diameter of the isolation support (37) and isolation disc (39) in this first variant are both greater than the outside diameter of the isolator (38). The isolation disc (39) is attached to an output shaft (40) which forms part of the output side (11). The isolation support (37) includes, or is attached to, the percussion anvil (28). The longitudinal axis of the impactor shaft (29) is coaxial with the longitudinal axes of the output assembly (27), and it is attached to, and extends away from, the exposed surface of the isolation support (28) towards the input section (10).

Figure 7:
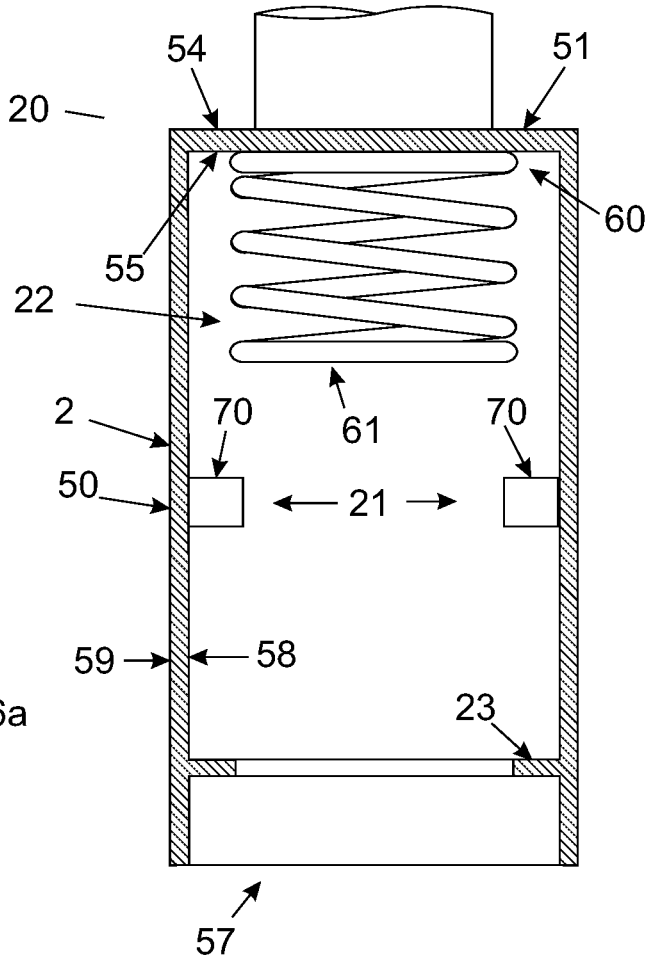
FIG. 7 is the cross-sectional view shown in FIG. 3 with only the input assembly shown.

Referring to FIG. 7 the input assembly (20) is shown separated from the percussion device (1). In this first variant the outer casing (2) includes a body portion (50) and a base portion (51) where the body portion (50) is a tube, and the base portion (51) is a disc forming one terminal end of the outer casing (2). The base portion (51) includes an input face (54) and a force face (55). Where the input face (54) is coterminous with the exposed surface of the outer casing (2) and the force face (55) is the opposite face of the base portion (51) that engages, and/or is coterminous, with one end, the primary end (60), of the force unit (22).

The outer casing (2) includes an open terminal end, the open casing end (57), where the open casing end (57) and the base portion (51) are opposite terminal ends of the outer casing (2).

The outer casing (2) includes a drive wall (58) and an exposed casing wall (59), the exposed casing wall (59) is the face of the outer casing (2) that is coterminous with the exposed surface of the percussion device (1). The drive wall (58) and the exposed casing wall (59) are the opposite faces of the outer casing (2). The alpha section (23) is a flat ring of material attached to, and extending perpendicularly from, a portion of the drive wall (58) close to the open casing end (57), an annulus extending from the portion of the drive wall (58). When the percussion device (1) is in the assembled form the alpha section (23) lies between the isolation support (37) and the isolation disc (39), with a sliding or clearance fit between the alpha section (23) and the isolator (38). There is also a sliding or clearance fit between the drive wall (58) and both the isolation disc (39) and the isolation support (37).

The force unit (22) is shown as a coil spring, either constant rate or variable rate, extending from the force face (55). The force unit in this case is coaxially aligned with the outer casing (2). The force unit (22) includes the primary end (60) and a secondary end (61), with the primary end (60) and secondary end (61) being opposite terminal ends of the force unit (22). As previously indicated the primary end (60) is the end closest to the force face (55). The force unit (22) can include springs, pressurised gas (e.g. gas strut), magnetic sources with like poles closest, or a plurality of items independently selected from this list.

Figure 8:
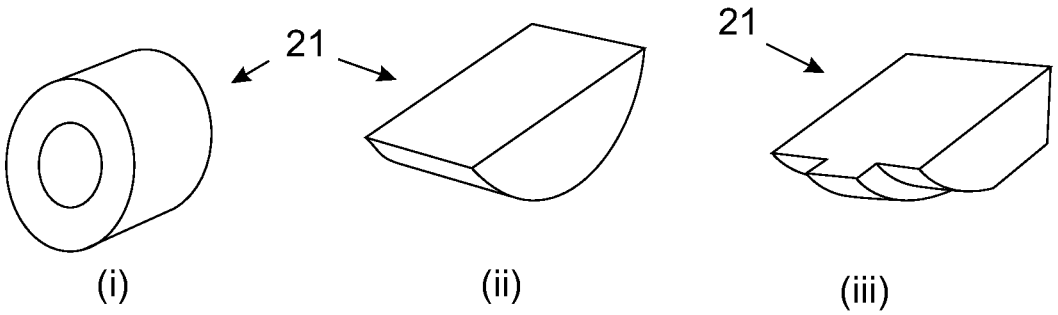
FIG. 8 is a series of different variants (i), (ii) and (ii) of a drive transmitter shown pictorially.

Referring to FIG. 3, FIG. 7 and, for the drive transmitter (21) shape, FIG. 8, two diametrically opposed drive transmitters (21) are shown, each is attached to, and extends from, the drive wall (58) towards the centre of outer casing (2). Each drive transmitter (21) includes a transmitter surface (70) which, when in use is in contact with the drive transmitter pathway (26). The drive transmitters (21) can be roller (as shown in FIG. 8(*i*)), a section of a disc with the curved surface forming the transmitter surface (70) (as shown in FIG. 8(*ii*)), or any other shape which, when the drive transmitter (21) is engaged with the drive transmitter pathway (26) the drive transmitter (21) can move along the drive transmitter pathway (26). For example, the drive transmitter (21) may be a roller attached by an axle to the drive wall (58), the shape shown in FIG. 8(*ii*) either rigidly or via a pin which allows it to change orientation, a pin, or similar rotating, hinged or fixed devices. The drive transmitters (21) are shown as rollers in FIGS. 3 and 7.

Referring now to FIG. 3 where the percussion device (1) is shown in the assembled condition with the impact end (31) shown spaced apart from the percussion anvil (28). The percussion impactor (25) is engaged with the impactor shaft (29). The drive transmitter pathway (26) is engaged with the drive transmitters (21) at the point where there is the maximum distance between the drive transmitter pathway (26) and the force input end (31). The force unit (22) is engaged with the percussion impactor (25) and applying maximum force to the percussion impactor (25). The alpha section (23) is immediately adjacent the isolator (38) and spaced apart from the isolation disc (39). The dimensions of the isolator (38) and the alpha section (23) are such that they form a sliding joint.

The cross-sectional shapes of the impactor shaft (29) and the IS tunnel (34) are complementary and do not allow differential rotational motion between them (unless the impactor shaft (29) has a longitudinal twist).

Figure 9:
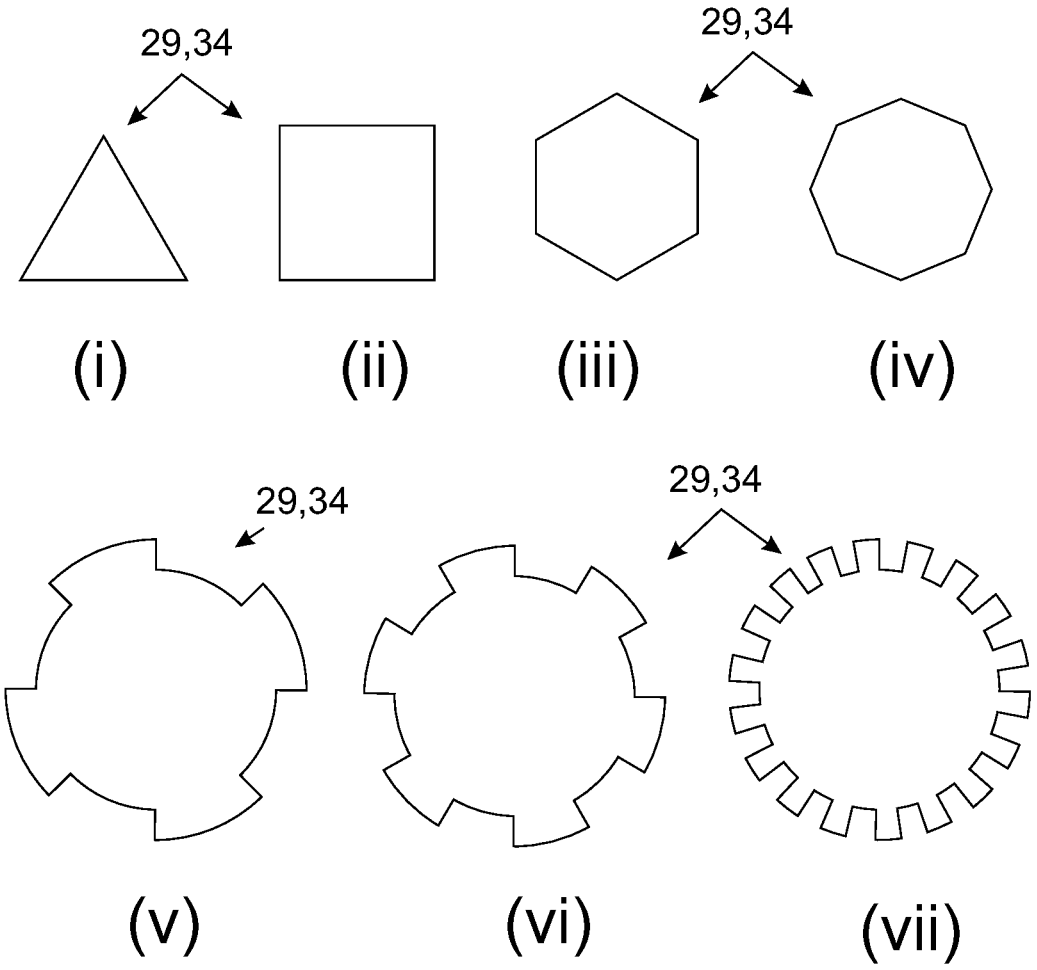
FIG. 9. is a series of cross sectional views (i) to (vii) of the impactor shaft or IS tunnel.

Referring to FIG. 9 (*i*) to (*vii*) some example cross sectional shapes for the impactor shaft (29) and IS tunnel (34) are shown, FIG. 9(*i*) to (*iv*) are three to 8 sided polygons (regular or irregular) and FIGS. 9(*v*) to 9(*vii*) are splined shafts/tunnels.

Figure 10:
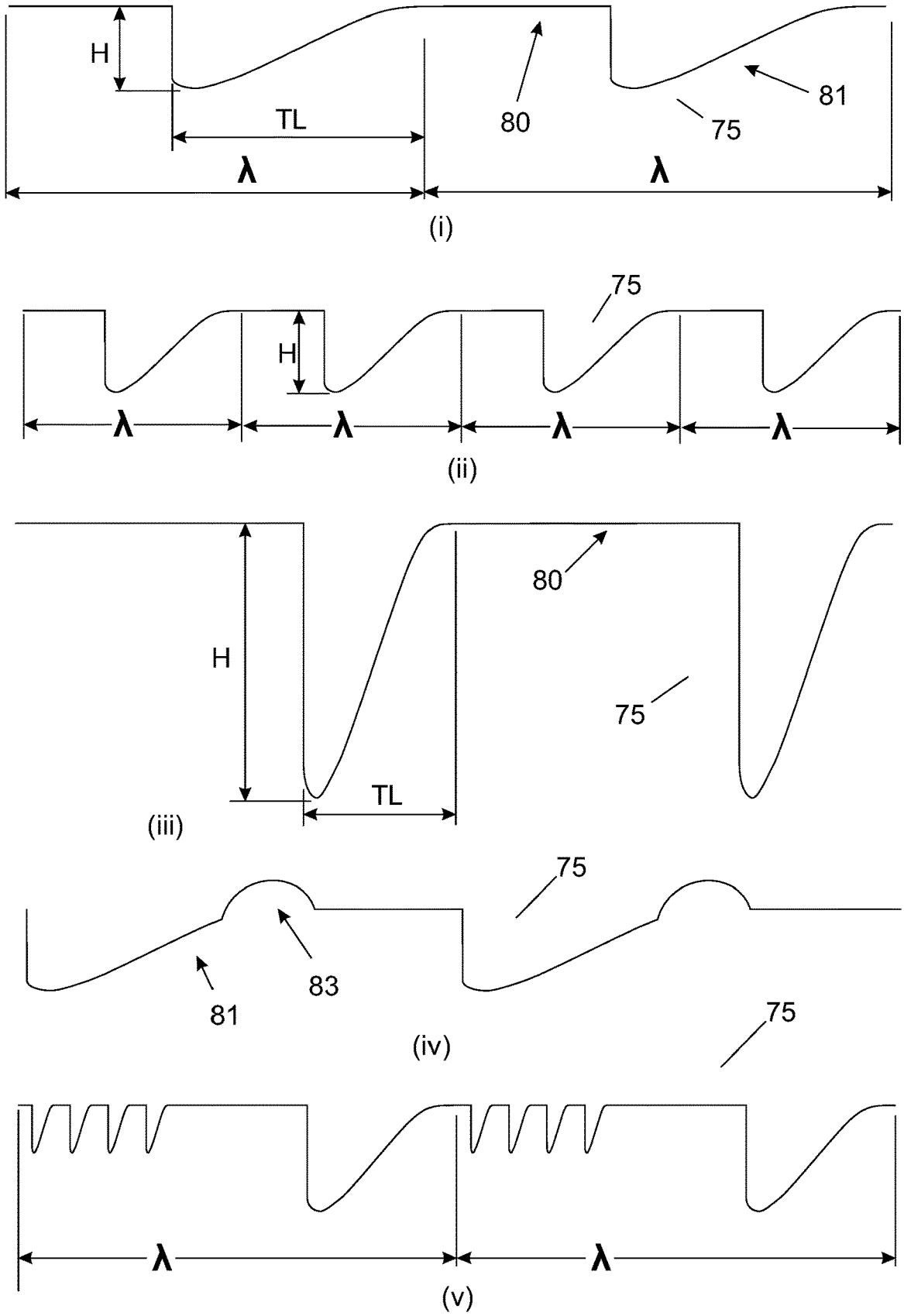
FIG. 10 is a series of waveforms which are a number of variants of the drive transmitter pathway, with the drive transmitter pathway flattened out.

Before describing this first variant of the percussion device (1) in use we will describe some variants of the drive transmitter pathway (26) by stretching it out and laying it flat so the pathway waveform (75) can be viewed. Referring to FIG. 10 (*i*) to (*v*) the drive transmitter pathway (26) waveform, the pathway waveform (75), is shown separated from the percussion impactor (25) oriented so that the FI end (33) (see FIG. 4) would be uppermost. In use the drive transmitter (21) would move right to left.

Referring to FIG. 10 (i) the pathway waveform (75) is shown consisting of two wavelengths (λ), each wavelength (λ) including a base section (80) and a tooth section (81). The base section (80) is shown about the same length as the tooth section (81). The tooth section (81) is essentially a right-angle triangle with the base lying on the same line as the base section (80) and the right angle on the left-hand side, with the exposed vertex being a smooth curve. The height (H) of the tooth section (81), the shortest distance from the base to the vertex, is shown as about 25% to 40% of the tooth length (TL). The pathway waveform (75) represents one complete rotation of the percussion impactor (25).

Referring to FIG. 10(*ii*) the pathway waveform (75) is similar to that shown in FIG. 10(*i*) but, consisting of four wavelengths (λ) with the height (H) about 45% to 65% of the tooth length (SL).

Referring to FIG. 10 (*iii*) the pathway waveform (75) is similar to that shown in FIG. 10(*i*) but the height (H) is approximately the same as the diameter of the pathway section (32) and the tooth length (TL) is about 30% to 40% of the base section (80).

Referring to FIG. 10 (*iv*) the pathway waveform (75) is shown with two wavelengths (λ) but the hypotenuse of the tooth section (81) commences with a scalloped-out section (83).

Referring to FIG. 10 (*v*) the pathway waveform (75) is shown consisting of two wavelengths (λ) each consisting of four saw teeth and one large saw tooth to show that a combination of different size waves can be used.

It should be noted that the height (H) may be as low as 1 mm to 10 mm and up to the diameter of the pathway section (32) (though it may be necessary in some applications to extend this to two times the diameter of the pathway section (32)). The maximum diameter of the percussion device (1) is the diameter of the hole that the drill bit forms, the percussion impactor (25) will have a diameter less than this as it fits within the outer casing (2).

One preferred method of operation of the percussion device (1) will now be described with reference to any one of FIGS. 1 to 10, and more particularly 11 to 13.

Figure 11B:
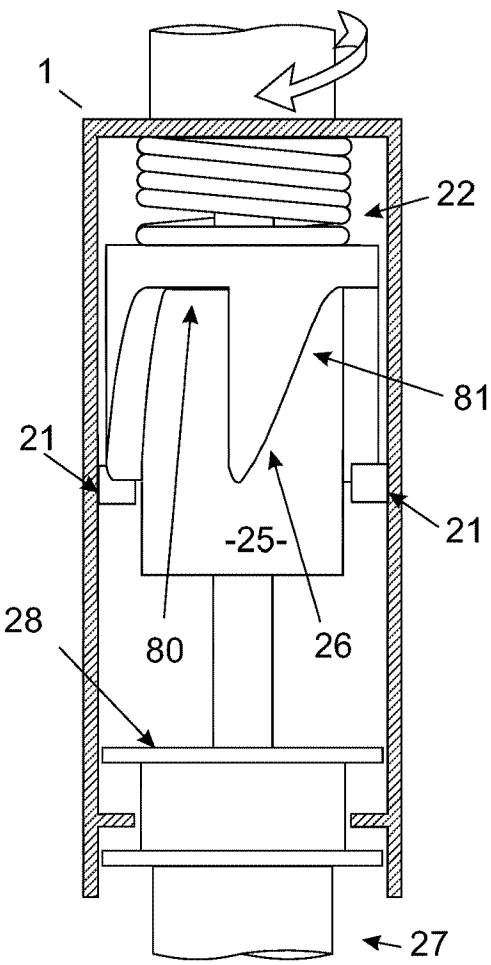
FIG. 11*b* is a cross sectional view similar to FIG. 11*a* with the percussion device in use with the output side still meeting rotational resistance with the energy stored within the force unit being released into the percussion impactor.
Figure 11A:
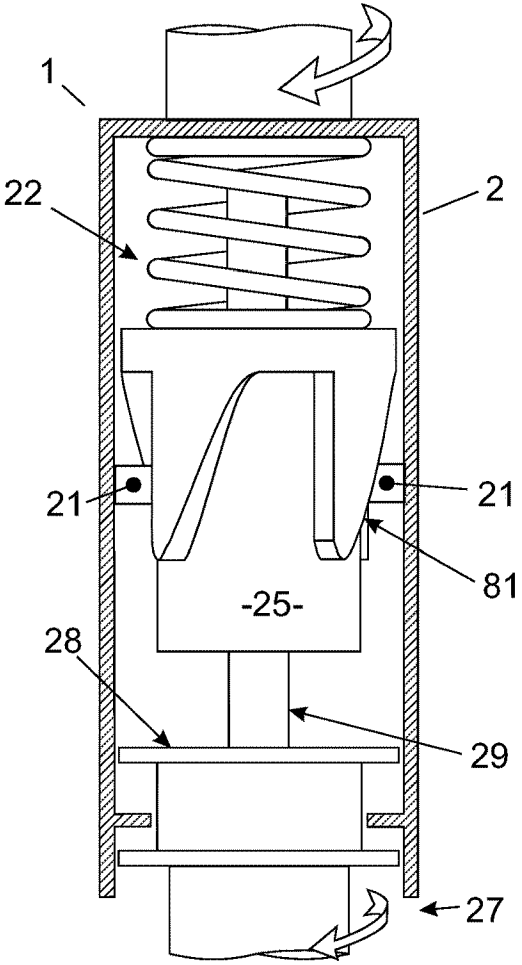
FIG. 11*a* is a cross sectional view similar to FIG. 11 with the percussion device in use with the output side meeting rotational resistance.
Figure 11:
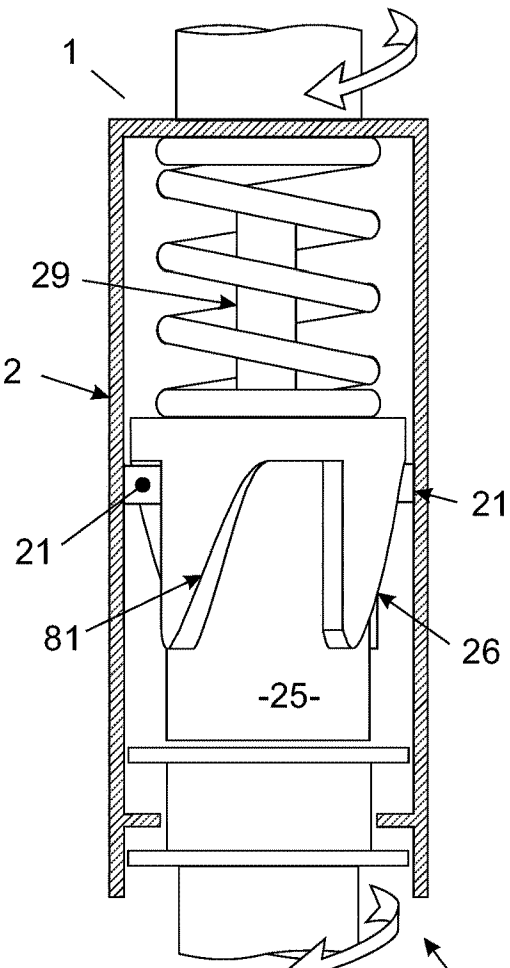
FIG. 11 is a cross sectional views similar to FIG. 3 with the percussion device in use with the output side rotating normally.

Referring to FIG. 11 specifically, and earlier drawings where required, a cross sectional view of the percussion device (1) in use with little or no resistance to rotation of the output assembly (27) present. The outer casing (2) is being rotated clockwise (left to right in the drawings) and the drive transmitters (21) have rotated around until they have contacted the tooth section (81) of the drive transmitter pathway (26) and started to apply force to the percussion impactor (25) which passes this rotational force onto the output assembly (27) via the impactor shaft (29). If the output assembly (27) is attached to a drill bit (not shown) then this may require some force to turn.

Referring to FIG. 11*a* specifically, and earlier drawings where necessary, a cross sectional view of the percussion device (1) in use with increasing resistance to rotation of the output assembly (27) present. As the resistance to rotation of the output assembly (27) the drive transmitters (21) climb up the tooth section (81), this occurs as the percussion impactor's (25) rotational velocity has slowed. This climb causes the percussion impactor (25) to move along the impactor shaft (29) away from the percussion anvil (28). This movement of the percussion impactor (25) causes the force unit (22) to store energy (if it includes a spring or pressurised gas then the spring and gas compress, if it includes like poles of magnets then it moves these together). This stored energy may reach a level where the resistance is insufficient to stop it being released, if this happens the output assembly (27) may experience an increased rotational velocity and possibly a minor percussive force as the percussion impactor (25) hits the percussion anvil (28). If the output assembly (27) continues to experience increased resistance, or is simply prevented from turning, then the drive transmitters (21) will continue to climb the tooth section (81) until they reach the vertex.

Referring to FIG. 11*b* specifically, and earlier drawings where necessary, a cross sectional view of the percussion device (1) in use with the drive transmitters (21) having passed over the vertex of the tooth section (81) and the force unit 22) releasing the stored energy into the percussion impactor (25). The resistance to the rotation of the output assembly (27) has continued and the drive transmitters (21) have been rotated past the vertex of the tooth section (81). As soon as the drive transmitters (21) clear the vertex of the tooth section (81) the percussion impactor (25) is free to move towards the percussion anvil (28) with the stored energy in the force unit (22) and any gravitational force to accelerate it. The percussion impactor (25) strikes the percussion anvil (28) transferring a percussive impulse to the output assembly (27). It should be noted that the drive transmitters (21) do not contact the base section (80) of the drive transmitter pathway ((26) at the time the percussion impactor (25) hits the percussion anvil (28). This may mean that the base section (80) is scalloped or cut away, or that the dimensions of the percussion impactor (25) are such that the base section (80) cannot contact the drive transmitters (21).

If the output assembly (27) is attached to a drill bit that has hit hard material and stopped this percussive impulse should clear it. The base section (80) puts a period of time between percussions which can be optimised for various drill and/or ground conditions. The intermittent percussive action when a drill is slowed by ground conditions to below a certain value is expected to improve penetration rates in certain problematic formations.

Figure 13:
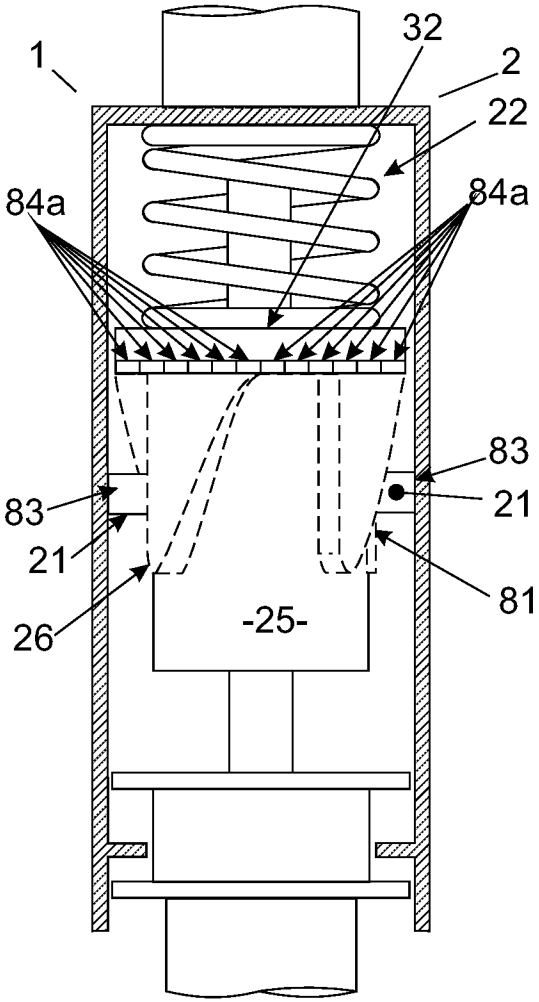
FIG. 13 is a cross sectional view similar to FIG. 11*a* with magnets forming the drive transmitter pathway (shown as dashed lines) and forming at least part of the drive transmitters.
Figure 12:
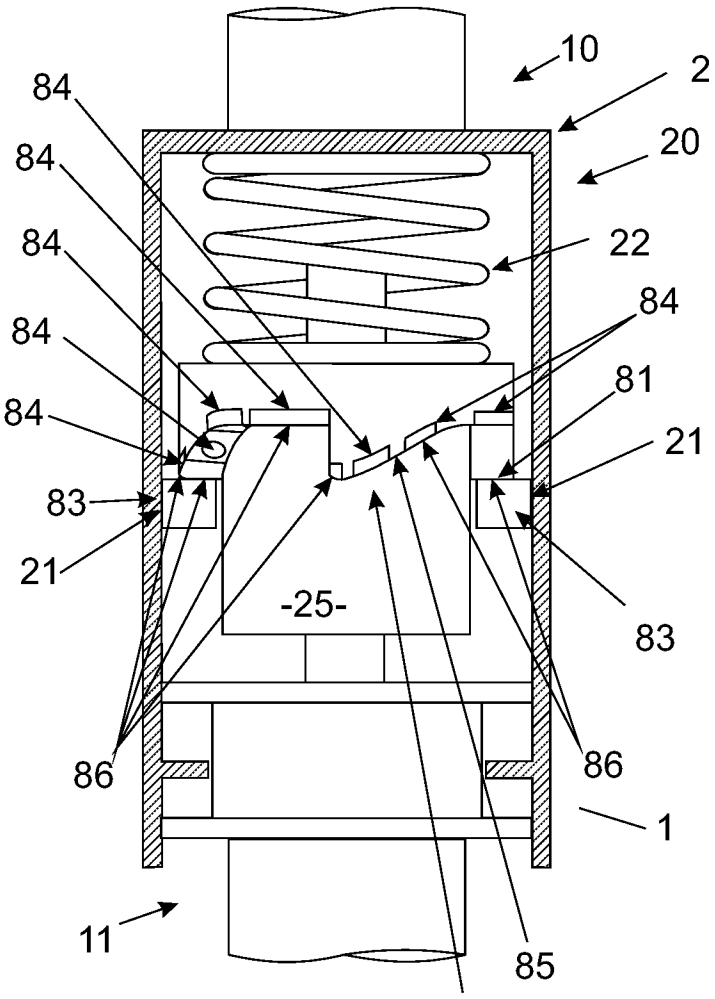
FIG. 12 is a cross sectional view similar to FIG. 3 with magnets embedded in the drive transmitter pathway and forming at least part of the drive transmitters.

Referring to FIGS. 12 and 13 variants of the percussion device (1) which incorporate magnets (83,84) as at least part of the drive transmitters (21) and drive transmitter pathway (26) are shown. It is believed these variants will reduce or eliminate the wear in the drive transmitters (21) and/or drive transmitter pathway (26) as the drive transmitter (21) moves along the drive transmitter pathway (26).

Referring to FIG. 12 the drive transmitter pathway (26) includes a plurality of pathway magnets (84) and each drive transmitter (21) is a transmitter magnet (83). In this variant the pathway magnets (84) are embedded into the surface, a pathway surface (85) of a solid drive transmitter pathway (26) with a common magnetic pole (86) facing away from that pathway surface (85). The face of each drive transmitter (21) facing the pathway surface also has the same magnetic pole exposed so that there is a repulsive force between the drive transmitter (21) and the pathway magnets (84). The strength of the repulsive force between the pathway magnets (84) and the transmitter magnets (83) is sufficient to prevent the drive transmitters (21) from contacting the drive transmitter pathway (26) or at least reduce any contact to a momentary low force contact. The magnetic field strength of each magnet (83,84) used is independently selected for the position, for example the tooth section (81) apex may require a higher magnetic field strength to prevent contact as the drive transmitter (21) passes over it.

In alternative variants the magnets (83,84) may be integrated into the components at manufacture or be independently replaceable should they be damaged or it is desirable to adjust the magnetic field strength at specific locations along the drive transmitter pathway (26). The magnets (83,84) can be any form of magnetic material, in any suitable shape, for example, discs, rings, strips, bars, plates or any required complex or simple 3-dimensional shapes. It is expected that they will be permanent magnets of either ferromagnetic or ferrimagnetic materials such as AlNiCo magnets, rare earth magnets, ceramic magnets or bonded magnets, though any sufficiently strong permanent magnetic material can be used. In some configurations electromagnets may be able to be used.

Referring to FIG. 13 a percussion impactor (1) including magnets (83,84*a*) similar to the variant shown in FIG. 12 is shown. The magnets (83,84*a*) have like poles facing so that there is a separating force between the drive transmitters (21) and the drive transmitter pathway (26). In this variant the drive transmitter pathway (26) is created by using tuned pathway magnets (84*a*) which have independently selected magnetic field strengths. In this variant the tuned pathway magnets (84*a*) are distributed in a flat disk around the percussion impactor (25), with each tuned pathway magnet (84*a*) being independently selected to form the required drive transmitter pathway (26).

By varying the magnetic field strength of the pathway magnets (84) (see FIG. 12), by using tuned pathway magnets (84*a*), it is believed that part or all of the drive transmitter pathway (26) can be formed without having to longitudinally offset each tuned pathway magnet (84*a*).

In this variant the drive transmitter pathway (26) is shown as dashed lines as it is a reflection of the combined magnetic field strength generated by the tuned pathway magnets (84*a*). With the magnetic field strength of each tuned pathway magnet (84*a*) being independently selected it is believed that the magnetic field strength variations can be used to form the required transmitter pathway (26). This variant would allow onsite variation of the drive transmitter pathway (26) without the need to carry more than one impactor (1).

It is possible to longitudinally offset some tuned pathway magnets (84*a*) in relation to the impactor (25) to further modify the magnetic field strength at specific locations, basically combine some of the features of the variant shown in FIG. 12 with that shown in FIG. 13.

Figure 14:
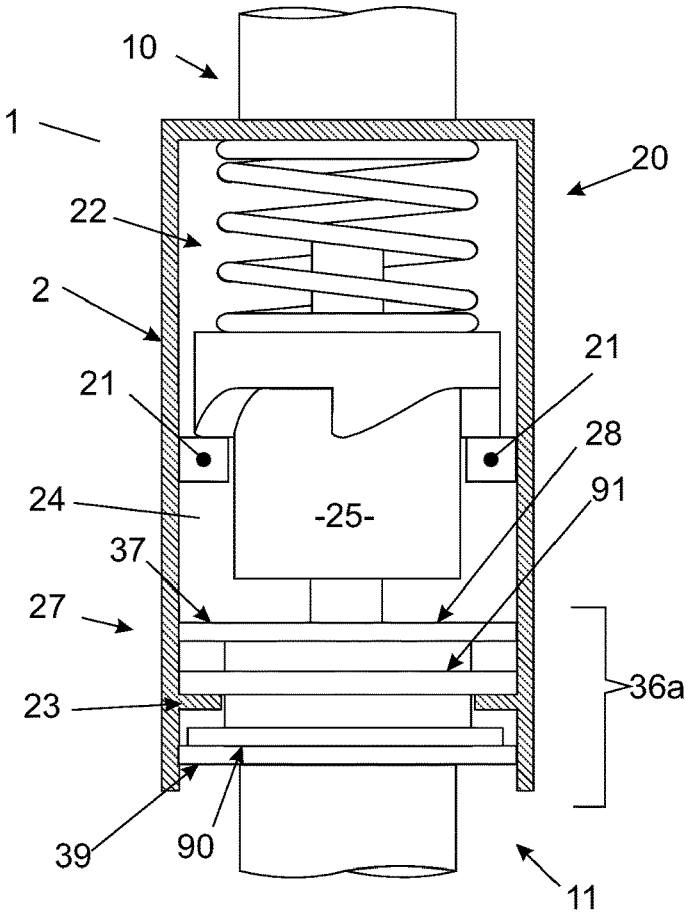
FIG. 14 is a cross sectional view, similar to that shown in FIG. 3, of a second variant of the percussion device.

Referring to FIG. 14 a second variant of the percussion device (1) is shown, this second variant includes an isolation buffer (90) between the alpha section (23) and the isolation disc (39). The isolation buffer (90) is a ring or annular piece of resilient material, for example an elastomeric material capable of absorbing all or part of a shock loading. Examples of suitable materials include rubber, natural or synthetic, foams or a combination of these, the isolation buffer (90) may be a sandwich of materials with a metal or hard plastic material facing an elastomeric core, with the elastomeric core being made up of one or more separately selected elastomeric materials. The isolation buffer (90) is present to minimise the differential longitudinal movement allowed between the input and output sides (10,11) and/or prevent damage to the isolation section (27) from the percussive impulse generated by the percussion impactor (25) hitting the percussion anvil (28). In some configurations the isolation buffer (90) is a pressurised bladder, pressurised with a gas, this gas pressure can be varied to allow the longitudinal distance the output assembly (27) can move in relation to the outer casing (2) to be set. This ability to set a predetermined maximum longitudinal movement could be used for the pile driving application where the distance a pile needs to be moved changes as it is driven into the ground.

An optional supplementary isolation buffer (91) is shown between the alpha section (23) and the isolation support (37); this is similar in configuration to the isolation buffer (90).

The isolation buffer (90) and the optional supplementary isolation buffer (91) are shown partially filling the gap, in some variants they may completely fill the gap.

In further configurations the isolation buffer (90) or supplementary isolation buffer (91), if present, includes, or is, a coil spring or annular magnets with like poles facing.

The supplementary isolation buffer (91) can, when present, act to isolate the percussion device (1) from impacts and other impulse forces applied by the components downstream of the output section (11). For example, if the percussion device (1) is attached to a drill bit (not shown) that impacts hard material causing it to bounce this impulse can be damped.

Properly dimensioned the isolation buffer (90) and the optional supplementary isolation buffer (91) can seal against the surface of the isolator (38) to minimise or eliminate the ingress of material into the interior of the percussion device (1).

Figure 16A:
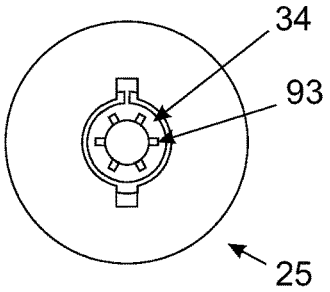
FIG. 16*a* is a plan view of the impactor for the output assembly variant shown in FIGS. 15*a* and 16.
Figure 15:
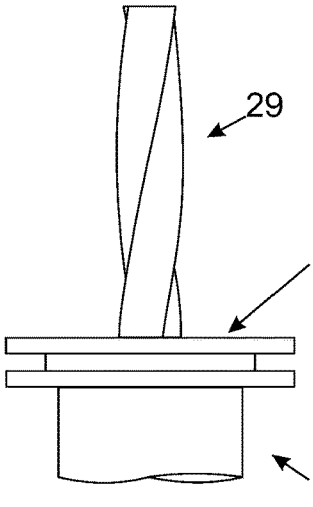
FIG. 15 is a side view of a variant of the output assembly which has a helically twisted impactor shaft.
Figure 15A:
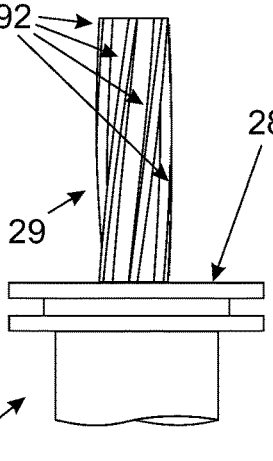
FIG. 15*a* is a side view of a variant of the output assembly which has impactor keys formed onto the impactor shaft.
Figure 16:
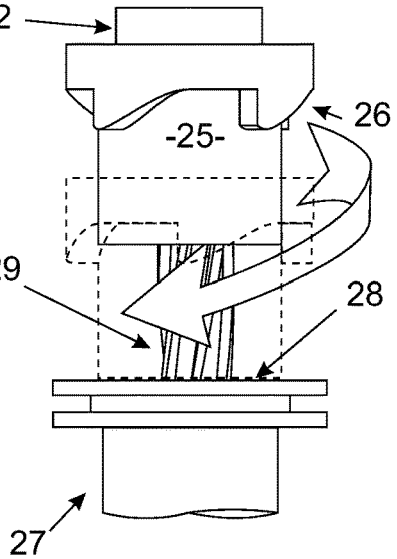
FIG. 16 is a side view of the variant output assembly with a percussion impactor at the point where the force unit is discharging the stored energy into the percussion impactor.

Referring to FIGS. 15, 15*a*, 16 and 16*a* (and other previous figures where required), a variant of the output assembly (27) which includes an impactor shaft (29) with a helical twist is shown. The twist shown is approximately ¼ turn but it is believed that in practice $1/20^{th}$ to ¾ a turn, inclusive, will be the acceptable range. With this variant output assembly (27) used the percussion impactor (25) will rotate backwards (against the direction of rotation of the outer casing (2)) as the distance between the percussion impactor (25) and the anvil (28) increases. Referring to FIG. 16 a percussion impactor (25) is shown at the moment when the energy stored in the force unit (22) is released, the percussion impactor (25) moves along the impactor shaft (29) rotating forwards in the direction of the arrow as it does so. When the percussion impactor (25) (shown in dashed lines) hits the percussion anvil (28) it imparts a rotational percussive impulse. It is believed that this rotational percussive impulse will clear stalled drill bits and, in some instances, drive piles more effectively or drill faster in certain formations. The optimum range for the twist is likely to be $1/20^{th}$ turn to ¼ turn. Though the helical twist is shown in FIG. 15 as an actual twist in the impactor shaft (29) itself, this is not the only way to achieve this rotational percussive impulse, for example one alternative variation is shown in FIGS. 15*a*, 16 and 16*a*.

In FIGS. 15*a*, 16 and 16*a*, the impactor shaft (29) is a splined shaft with a plurality of impactor shaft splines (92). Each impactor shaft spline (92) is an elongate ridge or tooth extending from the surface of the impactor shaft (29). Each impactor shaft spine (92) follows a helical path extending at least part of the length of the impactor shaft (29). Each impactor shaft spline (92), in use, engages with a complementary impactor spline channel (93) formed into the impactor shaft tunnel (34) (see FIG. 16*a*). The number of impactor shaft splines (92) shown is 6, however, as shown in FIG. 9 (*v*) to (*vi*) any number of splines from 4 to 20 are specifically shown and the range is likely to be any integer between 2 and 60, depending on the diameter of the impactor shaft tunnel (34).

Figure 17:
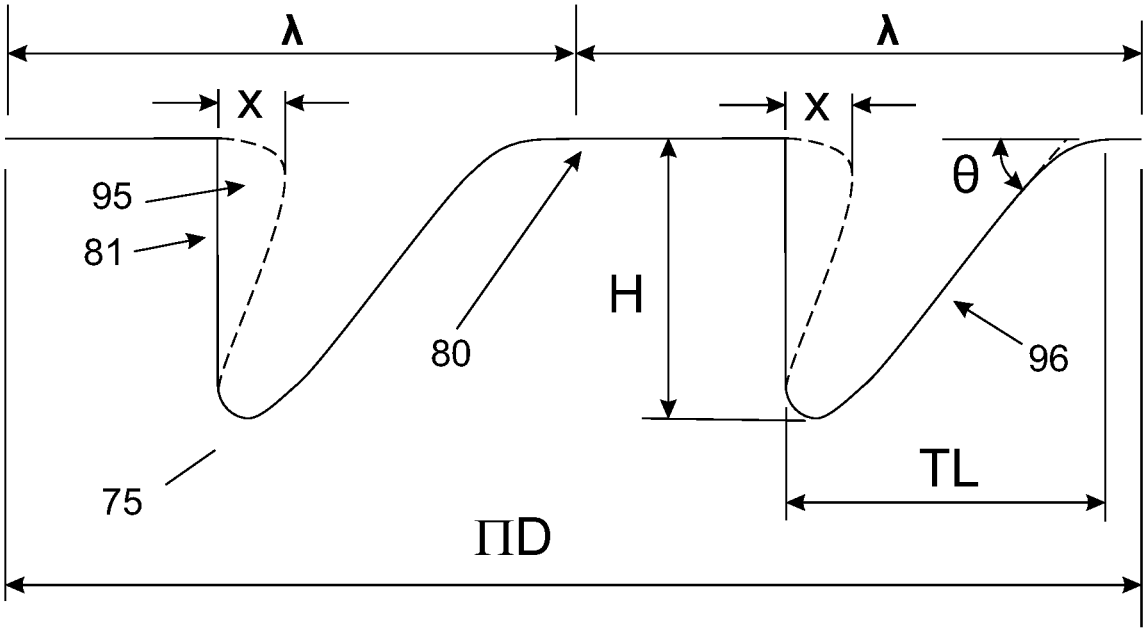
FIG. 17 is a view of an alternative two wavelength pathway waveform (75) for the drive transmitter pathway, with the vertical section of the tooth section cut back to allow for the variant twisted impactor shaft.

With a twist the vertical section of the drive transmitter pathway (26) could contact the drive transmitters (21) (not shown in FIG. 16, see FIGS. 11-11*b* for example). To prevent this contact the vertical section may need to be cut away so that it does not make contact. Referring to FIG. 17 a modified drive transmitter pathway (26) pathway waveform (75) with two wavelengths (λ) is shown. In this modified pathway waveform (75) the tooth section (81) of the pathway waveform (75) has the same basic shape as that described earlier, but, the lead section (95) of the tooth section (81) has been scalloped (shown as a dashed line), into a distance (x) so that the drive transmitters do not contact the lead section (95) as the percussion impactor (25) rotates along the impactor shaft (29) when the stored energy in the force unit (22) is released. The lead section (95) is the portion of the tooth section (81) that in a plain sawtooth wave is perpendicular to the base. The portion of the tooth section (81) that the drive transmitters (21) (shown in dashed lines) climb is the lift section (96). The length of the waveform (πD) is two wavelengths (λ) with the wave height (H) about the same as the tooth length (TL), where the tooth length (TL) is the length of the tooth section (81). The base section (80) is about the same length as the tooth section (81). The angle of the lift section (96) of the tooth section (81) to the base section (80) is 8, noting that this angle is simply a line along the average (mean) slope of the lift section (96).

Figure 18:
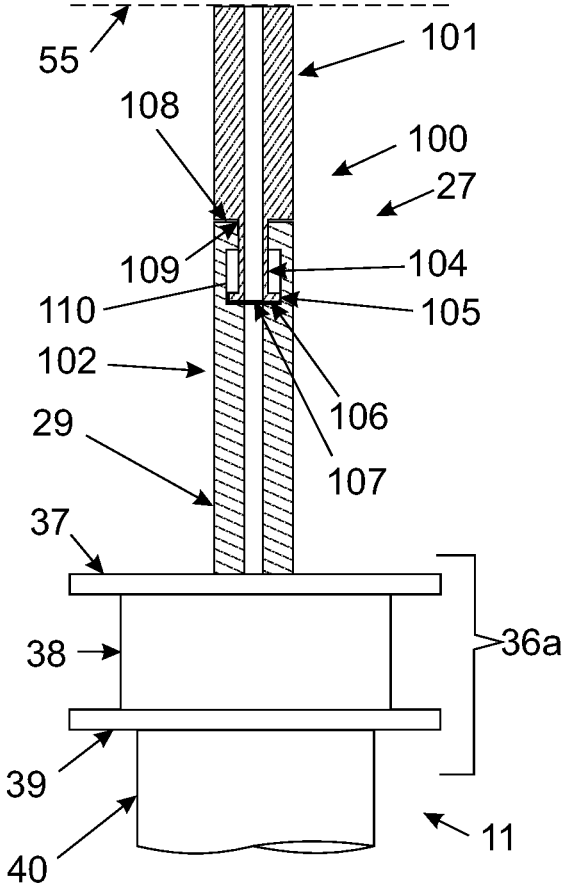
FIG. 18 is a side view of the output assembly with a variant of the impactor shaft shown in cross section.

Referring to FIG. 18 a variant of the output section (27) including an impactor shaft (29) with a sliding joint (100) that allows a fluid to be passed through the centre of the impactor shaft (29) is shown. In this case the impactor shaft (29) extends from the force face (55) (shown as dashed line) to the isolation support (37). This variant of the impactor shaft (29) includes a primary shaft (101) and a secondary shaft (102) where one terminal end of the primary shaft (101) is coterminous with the force face (55) and one terminal end of the secondary shaft (102) is coterminous with the isolation support (37). The primary and secondary shafts (101,102) each include an open-ended fluid pathway extending along their longitudinal, co-axially aligned, axes.

The primary shaft (101) includes a primary reduced section (104) and primary expanded end (105), the primary reduced section (104) is a length of the primary shaft (101) that has a smaller outside diameter than the minimum cross-sectional dimension of the remainder of the primary shaft (101). The primary expanded end (105) is the terminal end of the primary shaft (101) most distant from the force face (55) and the primary reduced section (104) is immediately adjacent to the primary terminal end (106). The primary expanded end (105) is an annulus with a primary shaft hole (107).

The secondary shaft has a tau terminal end (108) where the tau terminal end (108) is the terminal end of the secondary shaft (102) furthest from the isolation support (37). The tau terminal end includes a tau aperture (109) which is a circular aperture dimensioned to accept the primary reduced section (104) but too small to allow the primary expanded end (105) to pass through. The tau aperture is a pathway to a cylindrical void within the secondary shaft (102), a connection void (110). The diameter of the connection void (110) is greater than the diameter of the tau aperture (109). The primary reduced section (104) sits within the tau aperture (109) and the primary expanded end (105) sits within the connection void (110). The dimensions of the primary expanded end (105) and the connection void (110) are such that they form a sliding fluid tight seal that rotationally isolates the primary shaft (101) from the secondary shaft (102). The length of the primary reduced section (104) and the connection void (110) allows the length of the impactor shaft (29) to change whilst the fluid seal and rotational isolation remains. This variant of the output section (27) could also incorporate any of the known means of providing a fluid pathway that rotational isolates a primary shaft (101) and a secondary shaft (102) whilst allowing differential longitudinal movement and maintaining a fluid seal.

Figure 19:
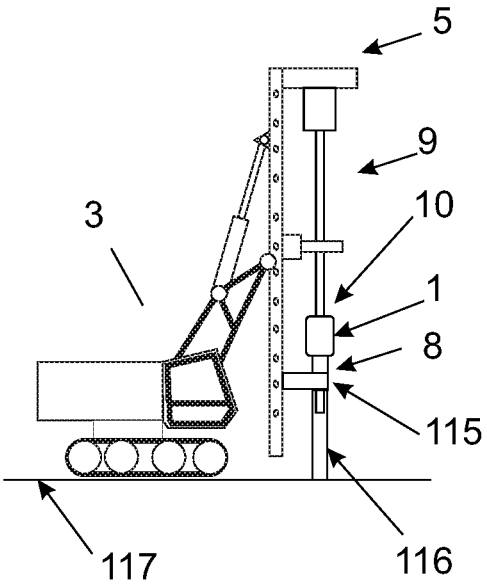
FIG. 19 is a side view of a rig with the percussion device used as a pile driver.

Referring to FIG. 19 a pile driving variant is shown with a locking device (115) attached, this locking device (115) prevents the output assembly (27) from turning, this locks the percussion device (1) so that it provides only a percussive impulse output (no rotation) to drive a pile (116) into the ground (117). The locking device (115) may simply be a brake drum/disc, engage a pin into an aperture, be a magnetic locking clutch, or anything similar; the locking device (115) simply reduces or stops the rotation of the output shaft (40). The locking device (115) is shown connected to the output side (11) of the percussion device (1) as this is where it is required, (115) may be permanently on, or be able to be engaged fully or partially when necessary. For a permanently 'on' percussion device (1) the output assembly (36) or output shaft (40) could be rigidly attached to the rig (3).

Figure 20:
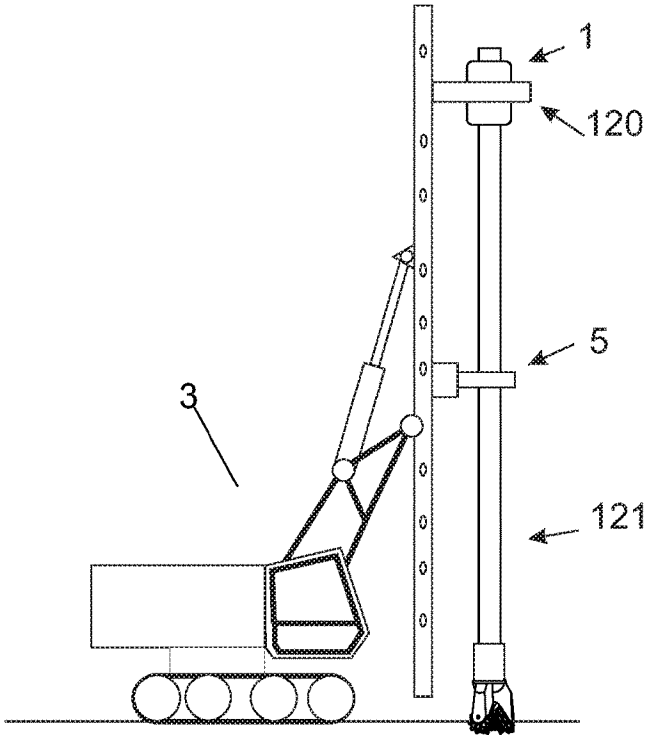
FIG. 20 is a side view of a rig with the percussion device driven by a separate drive unit.

Referring to FIG. 20 an alternative configuration with the percussion device (1) driven by a separate percussion drive unit (120), for example a motor or motor/gearbox unit that drives only the percussion device (1), is shown attached to a rig (3). The percussion device (1) in the configuration shown is above the main motor gearbox unit (5). In this configuration, to prevent percussive damage to the main drive unit (5), additional damping or percussive isolation may need to be added. The percussion device (1) could turn with the drill (121) but when percussive impulses were required the percussion drive unit (120) would be engaged. The percussion drive unit (120) would have a higher rotational velocity than the drill (121) causing the percussion device (1) to operate. The force unit (22) (see earlier drawings) would need to be sized so that rotational impulses applied by the percussion device (1) did essentially no damage to the main drive unit (5).

Figure 21:
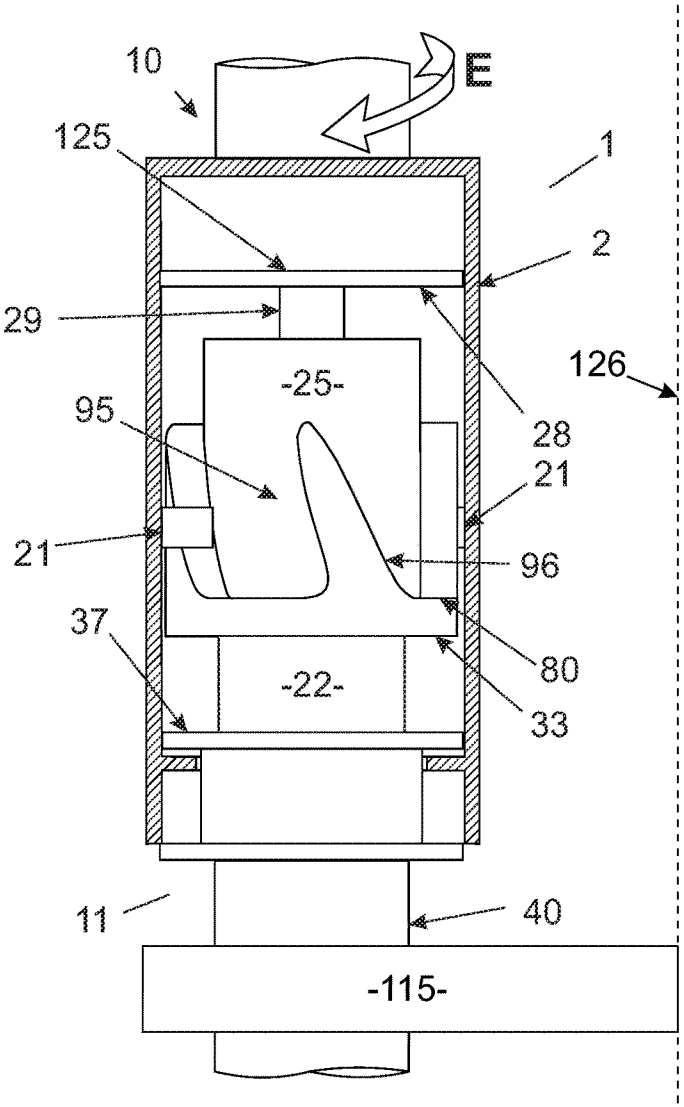
FIG. 21 is cross sectional view, with the outer casing cut along the line A-A and viewed in the direction of arrows A-A, of an extraction variant of the percussion device.

Referring to FIG. 21 an extraction variant of the percussion device (1) is shown, in this extraction variant the percussion device (1) is configured to generate a percussive impulse pulling the output section (11) towards the percussion device (1). This form of the percussion device (1) includes a locking device (115), similar to that described earlier. The locking device (115) is attached to the mast (126) (shown in dashed lines) of the rig (3), this locking device (115) allows the output section (11) to be locked to prevent rotation.

In the extraction configuration the percussion impactor (25) is inverted and the force input end (FI end) (33) is located adjacent to the isolation support (37), with the force unit (22) separating the isolation support (37) and percussion impactor (25).

The impactor shaft (29) includes a shaft terminal end (125), which is the terminal end of the impactor shaft (29) that is not attached to the isolation support (37). In this extraction variant the percussion anvil (28) is a disc that is coterminous with the shaft terminal end (125).

In operation the outer casing (2) is turned in the direction of arrow E, and the output shaft (40) is locked (prevented from rotating) by the locking device (115). The drive transmitters (21) move along the base section (80) up the lift section (96) storing energy in the force unit (22). The drive transmitters (21) pass over the vertex into the lead section (95) releasing the energy stored in the force unit (22) which accelerates the percussion impactor (25) towards the percussion anvil (28). The percussion impactor (25) hits the percussion anvil (28) transferring a percussive impulse to the impactor shaft (29) which transfers this percussive impulse to the output shaft (40). This percussive impulse is transferred to the object (not shown) to be extracted, which could be a pile, a drill bit, or a drill string or any components of that drill string.

Figure 22:
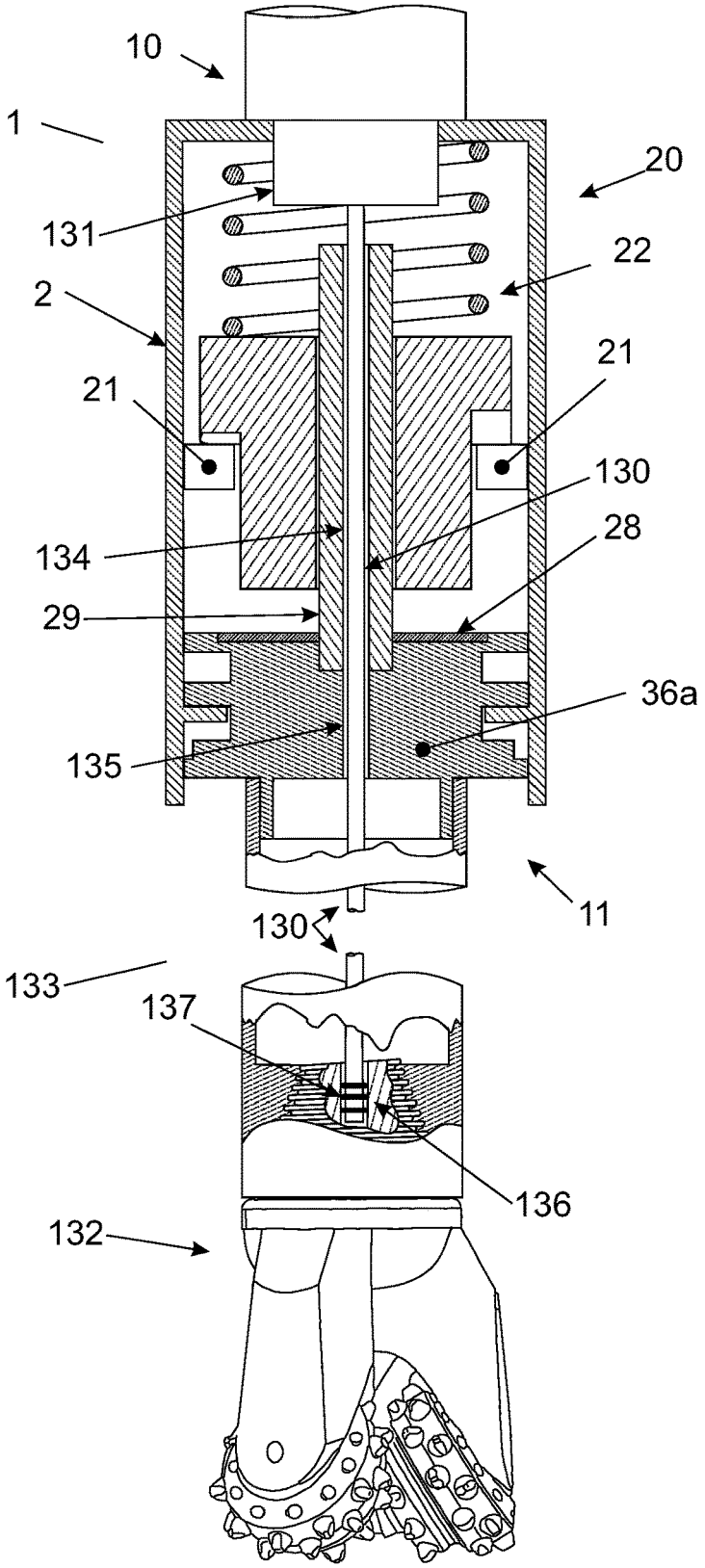
FIG. 22 is a partial cross-sectional view of the drill string from the percussion device to the drill bit, with the casing cut along the line A-A and viewed in the direction of arrows A-A and the drill bit partially sectioned, of an alternative variant allowing fluid delivery to the drill bit.

Referring to FIG. 22 a further variant that allows a fluid to be fed through the percussion device (1) is shown, with the percussion device (1) shown in sectional view except for a fluid conduit (130) and swivel (131). FIG. 22 also shows a drill bit (132) attached to the end of a drill string (133), the drill bit (132) shown is a tri-cone rock drill but any drill bit (132) could be present. The swivel (131) is a standard piece of equipment used for drills that provides a pathway for a material to be introduced into a rotating portion of the drill string (133) from a static point, or it allows a component within the drill string (133) to be isolated from the rotation of other components. In this case the swivel (131) provides a pathway for the fluid conduit (130) to pass through the outer casing (2) into the percussion device (1) interior.

The fluid conduit (130) is a tube or other form of hollow elongate member that provides a pathway for a fluid introduced above ground to be fed to the drill bit (132), or part of the drill string (133) below the percussion device (1). The fluid conduit (130) passes through an impactor pathway (134) which is a centrally aligned open ended hole through the impactor shaft (29), the impactor pathway (134) being dimensioned and configured to allow the fluid conduit (130) to be rotationally isolated from the impactor shaft (29). The fluid conduit (130) also passes through an output pathway (135) which is a centrally aligned open ended hole through the output section (36). The output pathway (135) being dimensioned and configured to allow the fluid conduit (130) to be rotationally isolated from the output section (36). The fluid conduit (130) then passes down the drill string (133) below the percussion device (1) to the drill bit (132). The fluid conduit (130) is connected to the drill bit (132) by a bit sliding joint (136). The bit sliding joint (136) allows the fluid conduit (130) to feed a fluid into the drill bit (132), or drill string (133) below the percussion device (1), whilst still rotationally isolating the fluid conduit (130) on the input side (10) from the drill bit (132). The bit sliding joint (136) allows for a certain amount of horizontal or co-axial longitudinal movement between the drill bit (132) and the terminal end of the fluid conduit (130), whilst maintaining a fluid seal, this may be accomplished in a similar manner to that shown in FIG. 18 or one or more sealing rings (137) could be attached to the fluid conduit (130). There are many ways of providing this bit sliding joint (136) and any one of them can be used. In some variants the void within the fluid conduit (130) may be coterminous with the output pathway (135) and the swivel (131) rotational isolates the fluid conduit (130) on the input side (10) from the fluid conduit (130) on the output side (11). In further variants the fluid conduit (130) is twinned with the drill bit (132).

Figure 23:
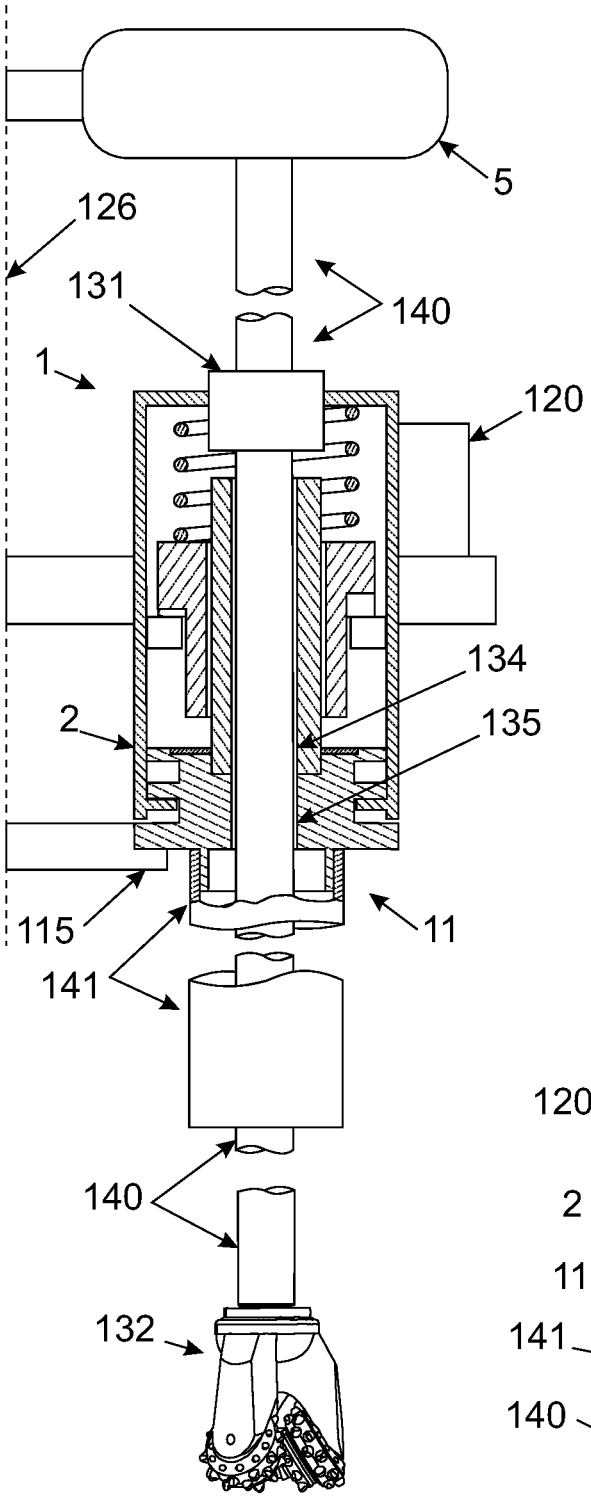
FIG. 23 is a partial cross-sectional view of a drill string, with the casing cut along the line A-A and viewed in the direction of arrows A-A, including the percussion device for use as a casing driver.
Figure 24:
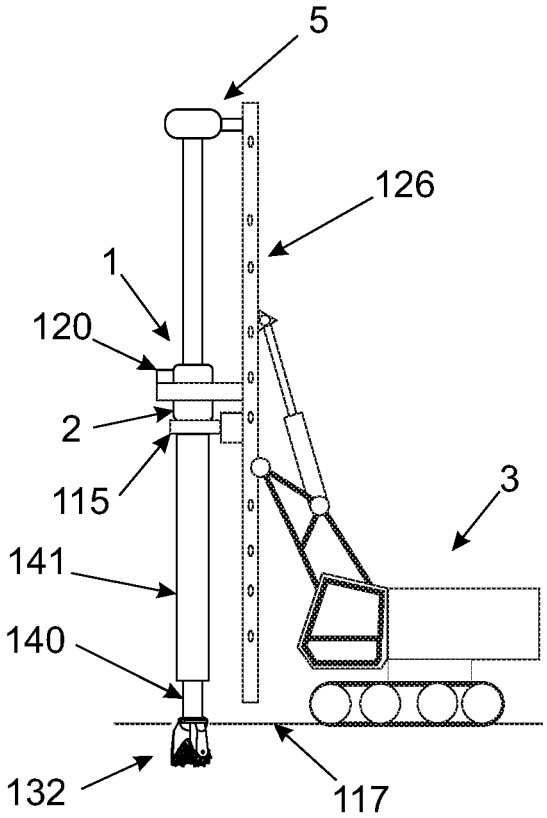
FIG. 24 is a pictorial view of a rig with a drill string with the percussion device configured as a casing driver.

Referring to FIGS. 23 and 24 the percussion device (1) is shown in use as a casing hammer/driver. In this variant the main drive unit (5) is attached towards the top of the mast (126) and in use it drives an inner drill string (140) which passes through a swivel (131), an impactor pathway (134), an output pathway (135) and the casing (141) being driven. The drill bit (132) is attached to a terminal end of the inner drill string (140) distal from the main drive unit (5). The percussion device (1) is rotationally isolated from the inner drill string (140) and not able to be directly rotated by the main drive unit (5).

The percussion device (1) is attached to a percussion drive unit (120) that, in use, allows the outer casing (2) to be rotated. A locking device (115) that can rotationally lock the output side (11) of the percussion device (1) is attached to the mast (126) and the percussion unit (1).

In use the main drive unit (5) drives the drill bit (132) rotationally and the rig (3) inserts it into the ground (117). When the casing (141) is to be driven into the ground (117) the output side (11) of the percussion device (1) is engaged with an end of the casing (141), the percussion drive unit (120) and locking device (115) are engaged to generate percussive impulses. The percussive impulses from the percussion device (1) are transferred to the casing (141) which assists in driving the casing (141) into the ground (117).

In this variation the percussion operation can be turned on and off by locking/unlocking the output shaft (4) which allows extra casing sections to be inserted and control the rate of casing (141) installation; and/or by engaging or disengaging the percussion drive unit (120).

Figure 25:
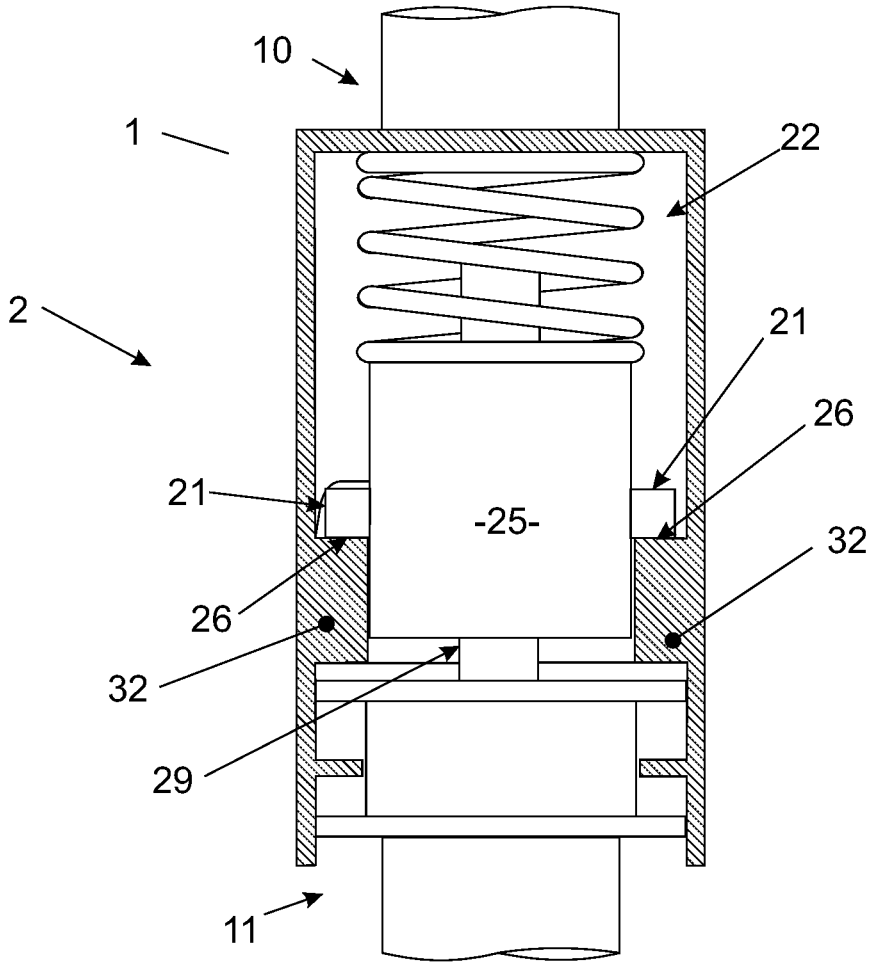
FIG. 25 is a cross sectional view, with the casing cut along the line A-A and viewed in the direction of arrows A-A, of a further variant of the percussion device where the pathways section is part of the outer casing and the drive transmitters are attached to the percussion impactor.

Referring to FIG. 25 a further variant of the percussion device (1) is shown as a partial cross-sectional view similar to that in FIG. 3, in this variant the pathway section (32) is part of the outer casing (2) rather than the percussion impactor (25). In this variant the drive transmitters (26) are attached to the first section (30) of the percussion impactor (25). The operation of the percussion impactor (25) is the same as previously described, as such this configuration can be used in any of the previously described variants without significant changes to the remaining components.

Though described with reference to a drilling rig (3) for drilling holes into the ground the percussion device (1) can be used with smaller power tools to provide a percussive impulse when drilling holes in hard or specific materials. In addition, the percussion device (1) can be used in any suitable application which requires the conversion of a rotational motion to a percussive and/or rotational motion.

In a further variant there are two interlinked percussion impactors (25), one for starting a pile and the other for driving it to completion able to be separated so as to engage the one required. This could also be a single percussion impactor (25) with two separate drive transmitter pathways (26) and a method of varying how far the drive transmitters (21) extend from the drive wall (58). The drive transmitters (21) engaging with the desired drive transmitter pathway (26) depending on the extension.

The force unit (22) for any of the variants can be any known device that allows the storage of energy as it is compressed, and the release of this energy as it is allowed to decompress. For example, compression springs with constant or variable rates, a plurality of compression springs of constant or variable rate, gas springs of variable or constant rate, solid elastomeric springs (for example those described in US20130069292) sometimes called elastomer springs, magnetic springs (for example those described in U.S. Pat. No. 3,467,973) or a combination of one or more of these.

For certain applications the force unit (22) may be a space that allows the percussion impactor (25) to rise upwards against gravity, the percussion impactor (25) simply falling under gravity to generate the percussive impulse.

Though not shown in all variants, for clarity, the isolation buffer (90) and optional supplementary isolation buffer (91) can be present in any variant. The isolation buffer (90) and optional supplementary isolation buffer (91) can be as described earlier or have a construction similar to that described for the force unit (22).

The isolation buffer (90) and optional supplementary isolation buffer (91) may act to seal the gap between the outer casing (2) and the isolator (38) or there may be additional sealing rings of known type present.

Where the term drive unit (5,120) is used it is intended to cover any drive device used to rotationally drive a drill string, drill or drill bit, for example a hydraulic or electric motor, a diesel engine, a hydraulic motor with gearbox, an electric motor plus gearbox, etc.

The number of drive transmitters (21) present can be any number from 1 upwards, the specific variants are likely to have 2 to 6, but for correct operation it is believed that the number should not exceed the number of wavelengths present in the drive transmitter pathway (25).

Figure 26:
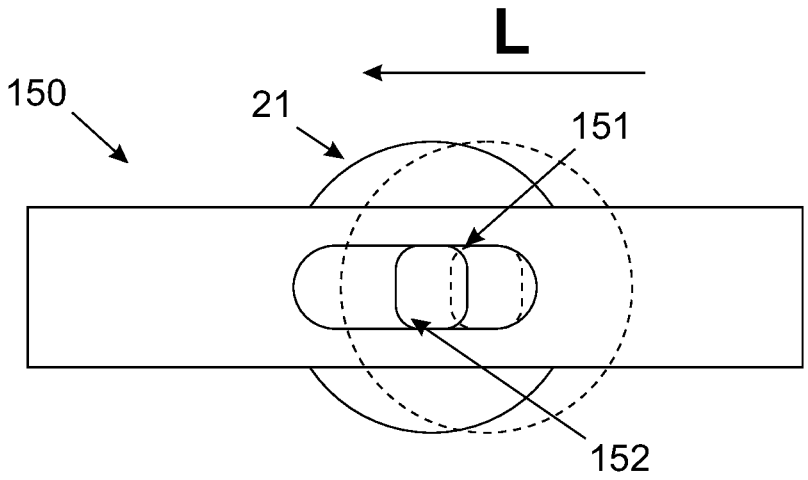
FIG. 26 is a side view of a sigma device.

With the loads applied to the or each drive transmitter (21) and drive transmitter pathway (26) a mechanism that reduces the load on, and/or contact force between, these components may be necessary to increase their lifespan, and/or increase the efficiency of the percussion device (1) (see any of FIGS. 3, 11 to 14, or 21 to 25). One way of reducing this load is to allow each drive transmitter (21) to move forward once it clears the apex of a tooth section (81). Referring to FIG. 26 one mechanism that will allow this is shown, this mechanism, a sigma device (150), is an annular cylindrical ring with a pin slot (151) for each transmitter pin (152). Depending on which version of the percussion device (1) is used this annular ring is attached to the outer casing (2) or the percussion impactor (25) and each pin slot is a circumferentially aligned obround slot extending into or through said sigma device (150). A drive transmitter (21) is attached to a transmitter pin (152) and each transmitter pin (152) lies within a complementary pin slot (151). Each transmitter pin (152) can slide (or otherwise move lengthwise) along the pin slot (151) if the load applied does not prevent this from happening. In operation, with the input side rotating (see FIG. 3 for example) in the direction of arrow L, and the or each drive transmitter (21) in contact with the lift section (96), but not passing over the apex of the relevant tooth section (81), the transmitter pin (151) is in the load position. In this load position each transmitter pin (152) is held in contact with a sigma load end (153), the transmitter pin (152)/drive transmitter (21) is shown in dashed lines in this load position. If a drive transmitter (21) passes over the apex of the relevant tooth section (81) then the load keeping the connected transmitter pin (152) drops off and it can move along the length of the pin slot (151) reducing the contact load between the drive transmitter (21) and the drive transmitter pathway (26). Please note that the transmitter pin (152) can have any suitable cross section, and in some configurations, it may be circular and act as an axle for the associated drive transmitter (21).

The sigma device (150) is optional and though in optimum configurations it is likely to be present the form of the sigma device (150) can vary.

Figure 27:
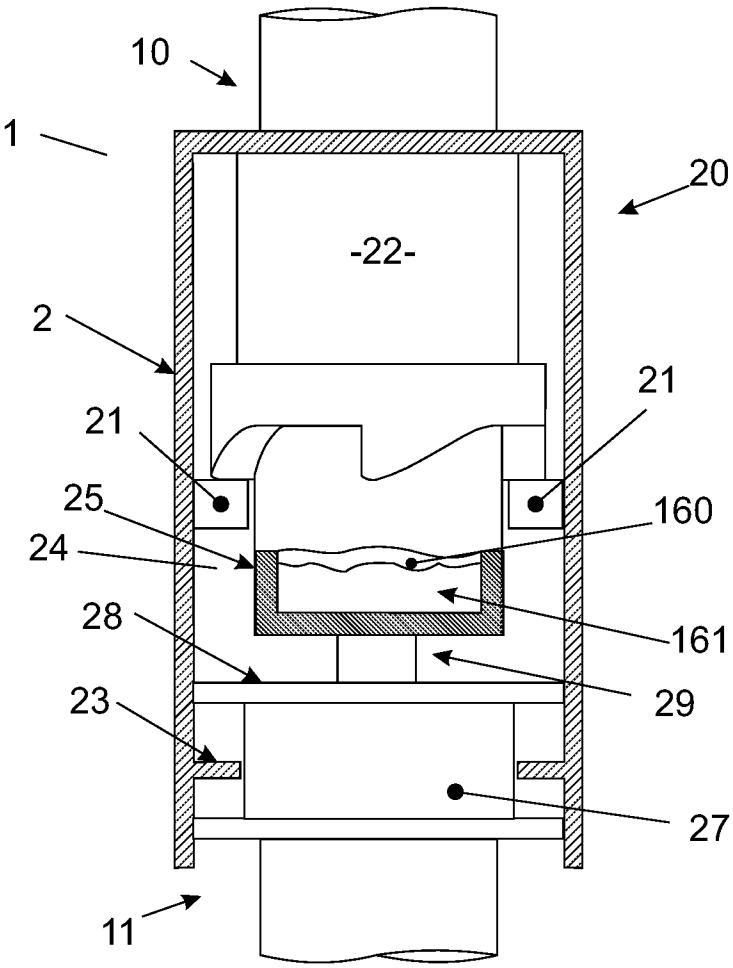
FIG. 27 is a cross sectional view of a variant with a force unit which is not a spring, and an optional fluid reservoir containing a reservoir liquid, with the outer casing cut along the line A-A and viewed in the direction of arrows A-A, of the percussion device.

For clarity FIG. 27 shows a cross sectional view of one variant of the percussion unit (1) which includes a force unit (22) that optionally does not include a spring. This variant is shown with the optional internal fluid reservoir (160) which contains a reservoir liquid (161). The reservoir liquid (161) may fill the fluid reservoir (160) but it may not be so as to impart certain dynamic characteristics to the percussion impactor (25).

Figure 28:
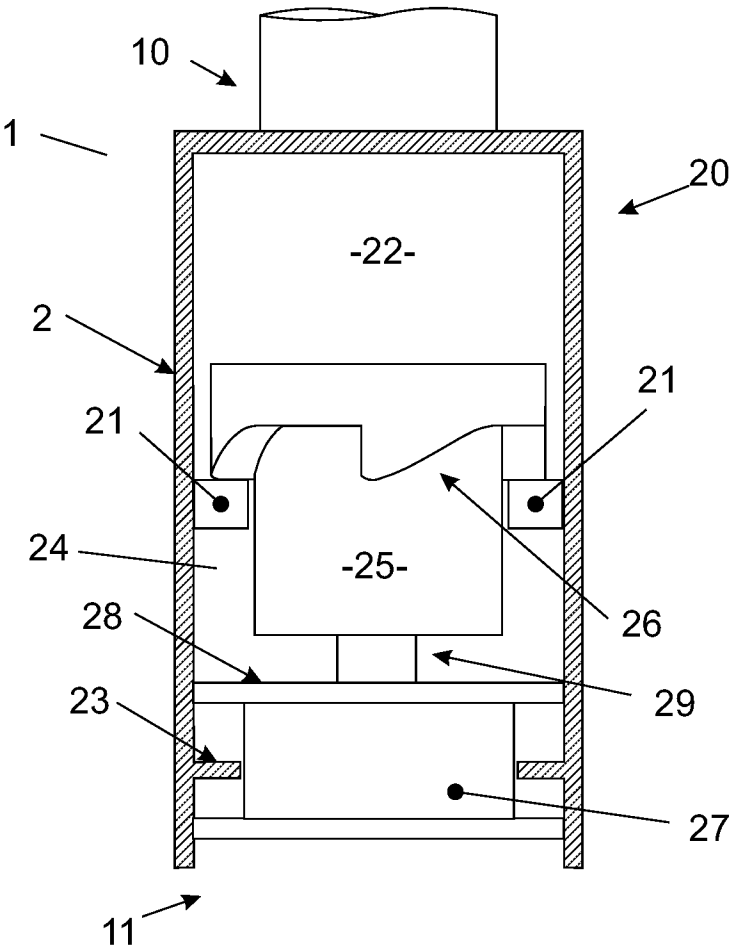
FIG. 28 is a cross sectional view of a variant with a force unit which is not a spring, with the outer casing cut along the line A-A and viewed in the direction of arrows A-A, of the percussion device.

Referring to FIG. 28 one variant of a percussion unit (1) is shown, in this variant the force unit (22) is in fact simply a void, the percussive force being generated by the percussion assembly (24) simply falling under the influence of gravity.

Figure 29:
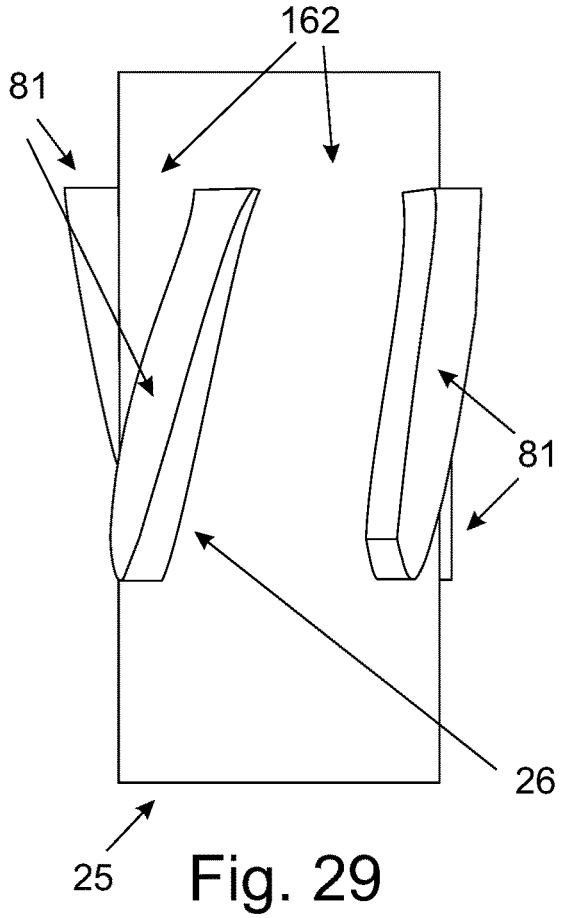

It should be noted that although the drive transmitter pathway (26) is shown as a continuous pathway, it may in fact be implemented as a series of disconnected teeth as the drive transmitters (21) are not intended to contact the base section (80) immediately downstream of the lift section (96). If a drive transmitter (26) impacts the base section (80) downstream of the lift section, as/before the percussive impulse is generated, it will likely reduce the percussive impulse generated as the percussion impactor (25) hits the percussion anvil (28), in addition the drive transmitters (21) may be damaged by the impact. This variant, implemented on a percussion impactor (25), is shown in FIG. 29 where the percussion impactor (25) consists of a plurality of spaced apart tooth sections (81), with the drive transmitter pathway (26) being the combination of the tooth sections (81) and the spaces (162) between. A similar variant (not shown) with the drive transmitter pathway (26) located on the drive wall (58) can also be implemented.

Figure 30:
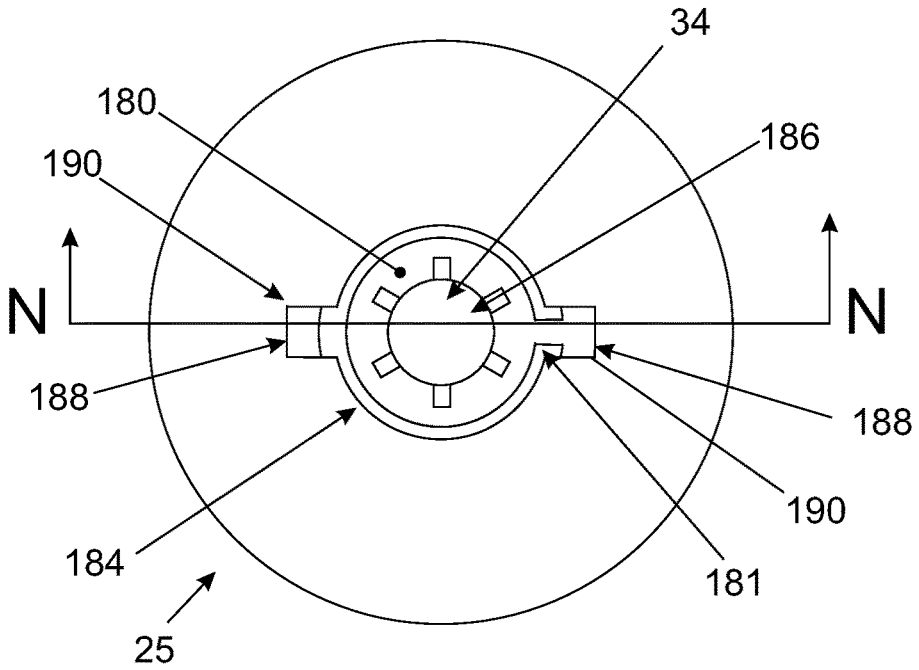
FIG. 30 is a top view of a further embodiment of the percussion impactor with a helically splined impactor shaft and keyed impactor shaft tunnel modules.
Figure 31:
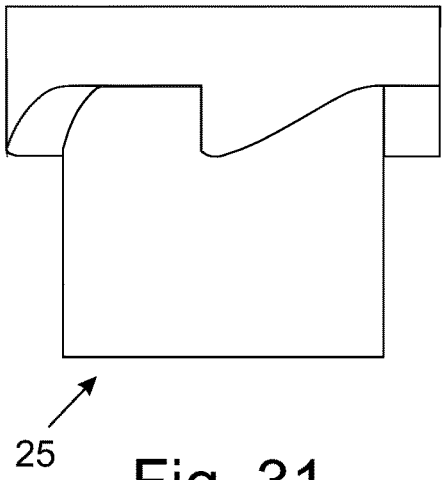
FIG. 31 is a side view of the further embodiment shown in FIG. 30.
Figure 32:
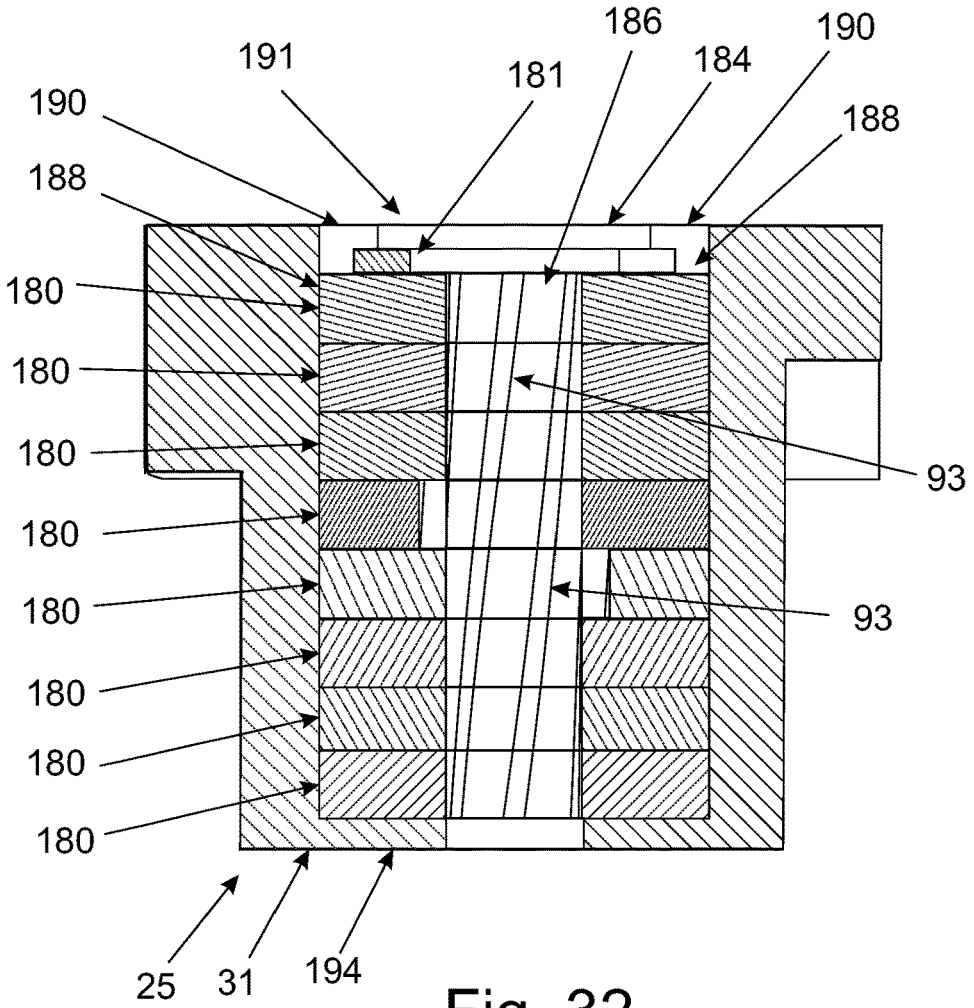
FIG. 32 is a side cross-sectional view of the embodiment shown in FIGS. 30 and 31 along the line N-N in the direction of the arrows.

Referring to FIGS. 30 to 32, a variant of the percussion impactor (25) is shown, in plan, side and cross-sectional views respectively, the cross-sectional view being along the line N-N and viewed in the direction of the arrows. This variant of the percussion impactor (25) is dimensioned, and configured, to be used with an impactor shaft (29) that includes a plurality of impactor shaft spines (92), as shown in FIG. 15*a*, 16 or 16*a*. In this variant the impactor (25) includes a plurality of impactor shaft tunnel modules (180), a module retention device (181) and a module tunnel (184).

Each impactor shaft tunnel module (180) includes a plurality of impactor spline channels (93), a tunnel segment (186) and two module keys (188). In use the plurality of impactor shaft tunnel modules (180) are stacked on top of each other with the combined tunnel segments (186) forming the impactor shaft tunnel (34). In this case there are 8 impactor shaft tunnel modules (180) shown, this can be any integer from 2 to 60, with a large number of impactor shaft tunnel modules (180) it may be possible to form them of sheets or plates.

Figure 33:
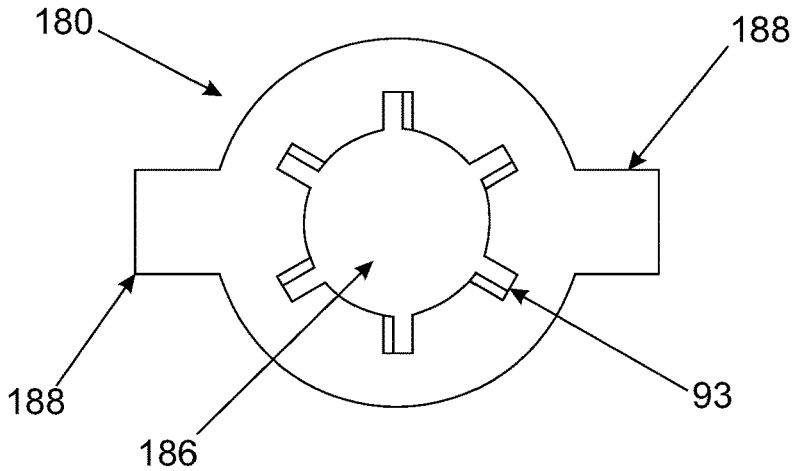
FIG. 33 is a plan view of an impactor shaft tunnel module.

Referring to FIG. 33, a plan view of one impactor shaft tunnel module (180) is shown with two diametrically opposed module keys (188) extending away from the centre, and the tunnel segment (186) located centrally. It should be noted that in certain configurations that the number of module keys (186) will fall in the range of 1 to 10.

Referring to FIGS. 33 and 30, the module keys (188) are shown dimensioned to engage with complementary features, module keyways (190) in the module tunnel (184). In use the combination of the module keys (188) and module keyways (190) co-operate to align the impactor shaft modules (180) with respect to each other and the impactor (25).

Each tunnel segment (186) is a tunnel through the respective impactor shaft tunnel module (180) with a shape and configuration that matches a portion of the impactor shaft tunnel (34).

Referring to FIG. 32 the impactor (25) is shown in cross section with the plurality of impactor shaft tunnel modules (180) stacked on top of each other within the module tunnel (184). The module tunnel (184) is a tunnel through the impactor (25) that includes a module section (191) and a module tunnel base section (194). The module section (191) is dimensioned to accept a plurality of impactor shaft tunnel modules (180). The plurality of impactor shaft tunnel modules (180) is retained in place within the module tunnel (184) by the module retention device (181). In this case a single module retention device (181) is shown in contact with the exposed terminal impactor shaft module (180), this single module retention device (181) is shown as a circlip. It being understood that there may be a single module retention device (181) for each impactor shaft module (180), and that they can each independently be any suitable method/device for releasably or permanently retaining, such as threaded rings, screws, keys, bolts, temporary welds, glue, friction (pressed in and then pressed back out) or a combination of these or similar methods/devices.

The module tunnel base section (194) is coterminous with the impact end (31) of the impactor (25) and it extends away from the impact end (31) providing a base upon which the impactor shaft tunnel modules (180) sit. The thickness of the module tunnel base section (194) will depend on the expected impact forces the percussion impactor (25) can deliver.

The height of each impactor shaft tunnel module (180) is less than the required impactor shaft tunnel (34), so the portion of the impactor spline channel (93) in each of the tunnel modules (180) is less complex to manufacture. In addition, if an impactor shaft tunnel (34) is damaged, one or all of the impactor shaft tunnel modules (180) can be replaced, it is not necessary to take the entire percussion impactor (25) out of service.

PREFERRED MODE OF CARRYING OUT THE INVENTION

Figure 34:
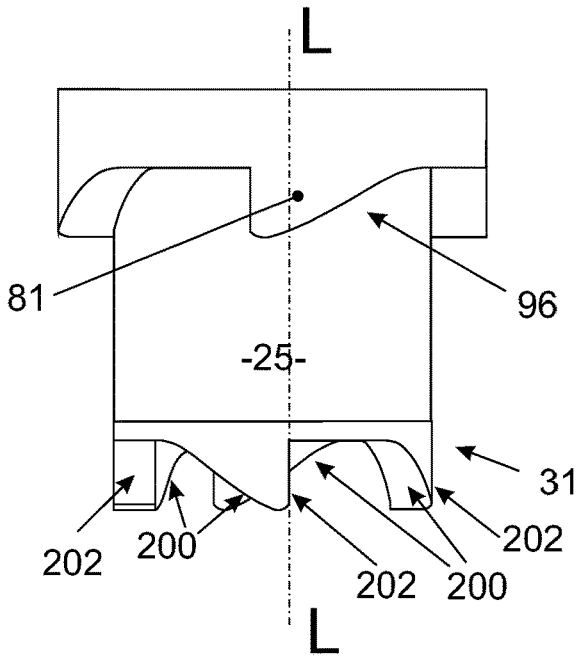
FIG. 34 is a side view of a further variant of the percussion impactor, this percussion impactor having angled impact surfaces.
Figure 35:
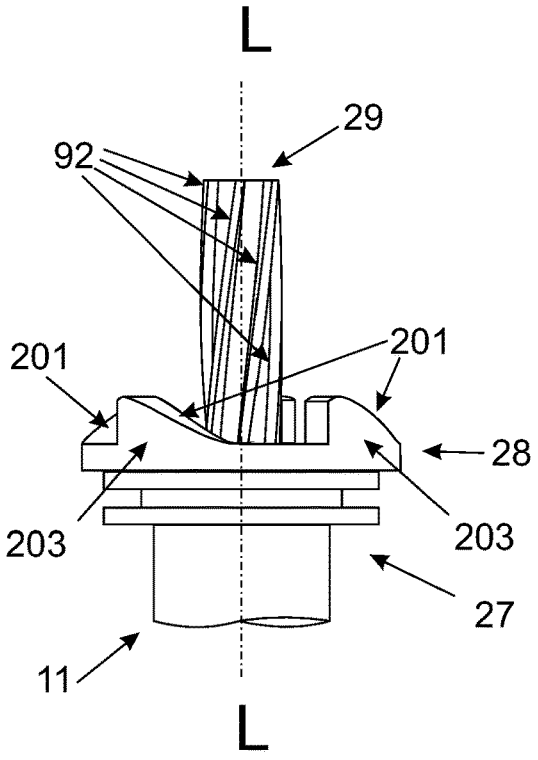
FIG. 35 is a side view of a variant output assembly used with the variant percussion impactor shown in FIG. 34.

Referring to FIGS. 34 and 35 a side view of a preferred variant of the percussion impactor (25) and output assembly (27), respectively, is shown. This variant is similar to that shown in FIGS. 15, 15*a*, 16 and 16*a* in that it includes a splined impactor shaft (29) with a plurality of impactor shaft splines (92). Where each impactor shaft spline (92) is an elongate ridge or tooth extending from the surface of the impactor shaft (29). Each impactor shaft spine (92) follows a helical path extending at least part of the length of the impactor shaft (29). Each impactor shaft spline (92), in use, engages with a complementary impactor spline channel (93) formed into the impactor shaft tunnel (34) (see FIG. 16*a*, 30 or 33). This splined impactor shaft (29), in use, causes the percussion impactor (25) to rotate backwards (against the direction of rotation of the outer casing (2) (see FIG. 14 for example)) as the distance between the percussion impactor (25) and the percussion anvil (28) increases.

Figure 36:
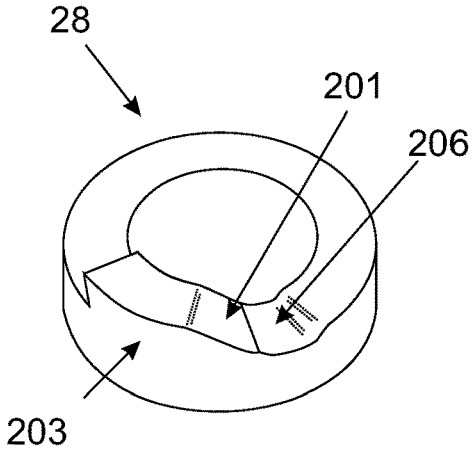
FIG. 36 is a pictorial view of an anvil with only one impact surface for the variant shown in FIGS. 34 and 35.

Referring to FIGS. 34 to 36, in this variant, the impact end (31) of the percussion impactor (25) and the surface of the percussion anvil (28) include one or more complementary, angled, impact surfaces (200, 201). In use these impact surfaces (200,201) transfer the percussive and rotative impulse from the percussion impactor (25) to the output side (11) via the percussion anvil (28).

Referring to FIG. 34 the impact end (31) is shown with four impactor impact teeth (202) where each of the impactor impact teeth (202), in side view, are essentially right-angle triangles extending away from the impact end (31) towards the anvil (28). The impactor impact surface (201) is the hypotenuse of the triangle, and it preferably faces in the opposite direction to the lift section (96) of the tooth section (81).

Referring to FIG. 35 the output assembly (27) is shown with four anvil impact teeth (203) each of the anvil impact teeth (203), in side view, are essentially right-angle triangles extending away from the output assembly (27) in the same direction as the impactor shaft (29). The anvil impact surface (201) is the hypotenuse of the triangle.

Figure 37:
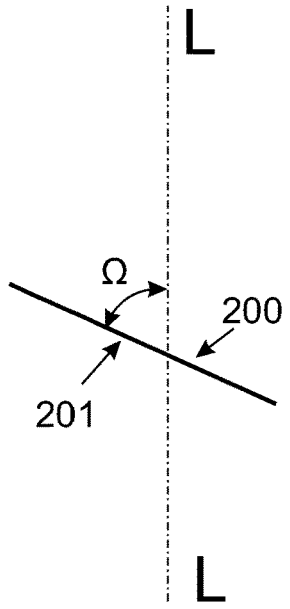
FIG. 37 is a side view showing only the impact surfaces of the variant shown in FIGS. 34 to 36 in contact, with the angle between these impact surfaces and the longitudinal axis of the impactor shaft and impactor shaft tunnel (L-L), Ω, shown.

Referring to FIG. 37, and where necessary FIGS. 34 to 36, a side view of the impact surfaces (200, 201) of an anvil impact tooth (203) and impactor impact tooth (202) in contact is shown. The angle the impact surfaces (200,201) make to the longitudinal axis (L-L) of the impactor shaft (29) or impactor shaft tunnel (34) (see FIG. 32), is angle Ω.

Figure 38:
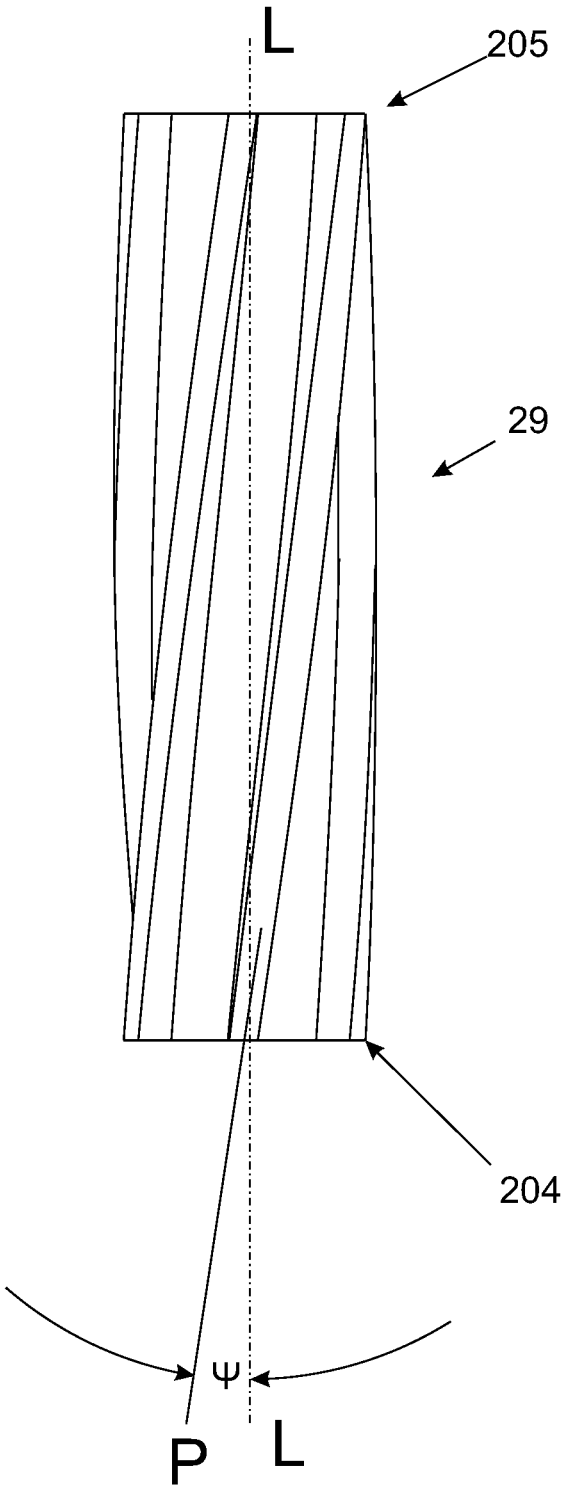
FIG. 38 is a side view of the splined impactor shaft for the variant shown in FIGS. 34 to 37 shown separately with a line P extending along the line of an impactor shaft spine.

Referring to FIG. 38 the impactor shaft (29) including an alpha terminal end (204) and beta terminal end (205) is shown in isolation. The alpha terminal end (204) and beta terminal end (205), are the longitudinally opposite terminal ends of the impactor shaft (29). The alpha terminal end (204) is the terminal end closest to the output side (11) (see FIG. 35). The angle between a line (line P) extending from an impactor shaft spine (92) and the longitudinal axis (L-L) of the impactor shaft (29) is angle Ψ.

Figure 39:
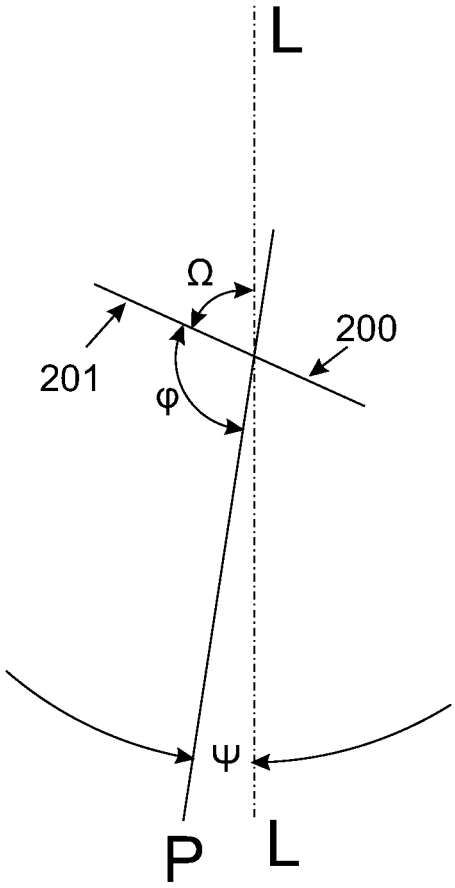
FIG. 39 is a pictorial view showing the angles between the longitudinal axis of the impactor shaft (L-L), the impact surfaces and line P.

Referring to FIG. 39 the angle between the impact surfaces (200, 201) and the line P is angle φ. The sum of angles Ω, Ψ and φ is 180°. The angle φ is expected to be between 75° and 135°, and most likely between 85° and 105°.

Angling the impact surfaces (200,201) is believed to reduce the forces applied to the impactor shaft splines (92) or impactor spline channels (93) thus potentially reducing damage and improving the transmission of the rotational/percussive impulses between complementary impact surfaces (200,201).

Referring to FIG. 36 a single anvil impact tooth (203) is shown, in this case the anvil impact tooth (201) is a quadrilateral (a right trapezoid/trapezium) when viewed side on with the impact surface (201) being the angled side. In this case the anvil impact tooth (203) makes up only a small percentage of the circumference.

The lead up to each the anvil impact tooth (203) may include a depression (206) to reduce the possibility of the impactor impact teeth (202) impact surface (200) contacting part of the anvil other than the anvil impact teeth (203) impact surface (201).

In alternative embodiments of the preferred embodiment some or all of the impact surfaces (200,201) are formed into the exposed surface of the impact end (31) and/or percussion anvil (28). In further alternative variants the impact surfaces (200,201) are replaceable items that can be changed onsite. This preferred embodiment could also include magnets similar to those shown in FIG. 12 or 13.

As can be seen various components from different variants and/or embodiments can be combined without departing from the inventive concept to achieve different operational parameters. For example the spacing between the tooth sections, the number of tooth sections, the length of the lead section, whether the drive transmitters are attached to the percussion impactor or the casing, the number of drive transmitters, whether the drive transmitter pathway is a series of spaced apart tooth sections or a continuous path, whether the drive transmitter pathway is formed partially or completely in physical form or is a pathway partially or completely formed by a plurality of magnets of differing field strength around the impactor, whether the drive transmitter pathway is made up of a series of separated or connected tooth sections, whether the drive transmitter pathway is a combination of the previously mentioned variations, the form of the force unit, the form of the drive transmitters, the presence of a sigma device, or any similar components can be combined without deviating from the inventive concept.

Figure 40:
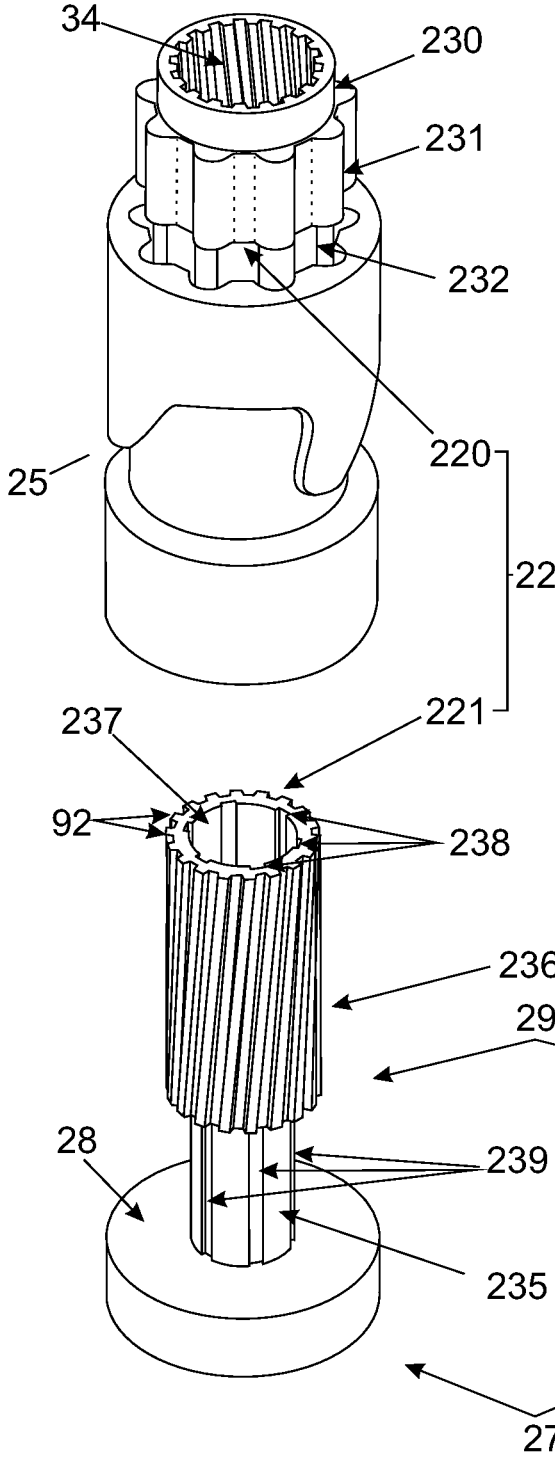
FIG. 40 is an exploded pictorial view of a modification that includes interchangeable splined section of the impactor shaft/splined impactor tunnel set with the set components separated from the engagement features in the impactor and impactor shaft.
Figure 41:
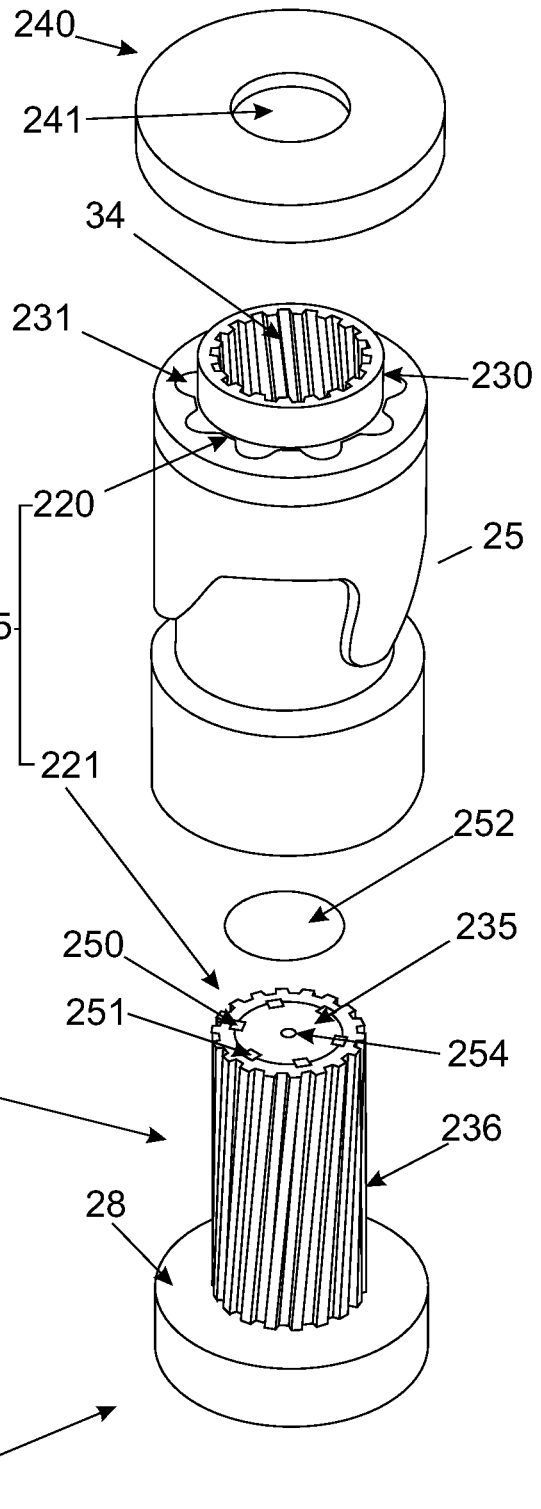
FIG. 41 is an exploded pictorial view of the modification described in FIG. 40 with the set components engaged with the engagement features in the impactor and impact shaft, but not locked in place.

For any of the variants or embodiments previously described the following modification, shown in FIG. 40 and FIG. 41, may be incorporated. Referring to FIGS. 40 and 41 a variant of the percussion impactor (25) and portion of the output assembly (27) that includes the percussion anvil (28) and impactor shaft (29) is shown in exploded view. This variant includes an interchangeable splined tunnel module (220) and splined shaft module (221), a splined module set (225).

The splined tunnel module (220) includes a first tunnel module section (230) and a tunnel module plug section (231) where the first tunnel module section (230) is a cylinder. The module plug section (231) is similar to a spur gear in shape with a plurality of teeth where each tooth has a rounded root and tip. The circumscribed diameter of the module plug section (231) is greater than the diameter of the first tunnel module section (230). The impactor shaft tunnel (34) is co-axially aligned to, and formed in, the splined tunnel module (230).

The percussion impactor (25) includes a co-axially aligned void, a tunnel module socket (232) with a cross section matching that of the tunnel module plug section (231).

The impactor shaft (29) in this variant is made up of an impactor shaft core (235) and a splined sleeve (236). The splined sleeve (236) includes a core tunnel (237) which is an axially aligned open ended tunnel extending longitudinally through the splined sleeve (236), and the impactor shaft splines (92) which extend from the exposed surface of the splined sleeve (236).

The core tunnel (237) includes a plurality, six are shown, of core keyways (238) each of which is a longitudinally aligned channel extending into the core tunnel (237). The impactor shaft core (235) is a cylinder which includes a plurality of shaft keyways (239), six are shown, each of which is a longitudinally aligned channel extending into the impactor shaft core (235).

In use a splined module set (225) which includes a splined tunnel module (220) and a splined shaft module (221) incorporating complementary impactor shaft tunnel (34) and impactor shaft splines (92) respectively is selected. The tunnel module plug section (231) is fully inserted into the module socket (232) then a tunnel module lock device (240) is engaged with the impactor shaft core (235) and screwed down to releasably lock the splined tunnel module (230) into the impactor (25).

The tunnel module lock device (240) is similar to a normal screw cap for a bottle or jar but it contains a hole in the cap, a tunnel module lock hole (241). The tunnel module lock hole (241) dimensioned to allow the first tunnel module section (230) to extend through the tunnel module lock device (240).

In use the splined sleeve (236) is fully engaged with the impactor shaft core (235) and complementary tunnel keyways (238) and shaft keyways (239) are aligned forming sleeve keyways (250). A sleeve key (251) which is an elongate strip of material with a cross section matching a complementary sleeve keyway (250) is inserted into each sleeve keyway (250) to rotationally releasably lock the impactor shaft core (235) and splined sleeve (236) together. A locking disk (252) is then used to prevent differential longitudinal movement between the impactor shaft core (235) and splined sleeve (236). The locking disk (252) engages with a complementary feature in the impactor shaft core (235), a threaded hole (254) though anything similar could be used.

Though the tunnel module plug section (231) and tunnel module socket (232) are shown as a particular shape, their cross section can be any complementary cross section that once engaged does not allow differential rotation between the tunnel module plug section (231) and tunnel module socket (232). For example, the complementary cross-sectional shape could be any of the shapes shown in FIG. 9, with or without rounded vertices, or anything similar.

The advantage with using a splined module set (225) is that it is possible to change the angle of the impactor shaft spline (92) onsite to suit the ground conditions found. It is also expected that the cost to replace a splined module set (225) for a lower cost than a percussion device (1) or percussion impactor (25) and impactor shaft (29).

Expected Ranges

Where the ranges include the terminal figures these are included in the range.

Number of wavelengths per complete rotation of the percussion impactor (25)=1 to 40, preferably any number from 2 to 20. Smaller diameter applications may extend this range to 1 to 1000, but this is yet to be confirmed and some may not be practical.

Height (H)=2×the diameter of the drill bit to 1 mm, preferably about the diameter of the drill bit to 5 mm. If there is no drill bit then the range is 1.2 m to 1 mm. Between 20 mm and 900 mm is expected to be most useful for drilling operations.

Notwithstanding the above ranges it is expected that for drilling rig applications the percussive impulse frequency will be from 0.1 to 150 Hz, though some applications may fall in the range of 0.05 Hz to 500 Hz.

Where a range of integers from x to y is indicated, then any single integer within that range (including the terminal figures) is envisaged i.e. an integer range of 5 to 10 can be 5, 6, 7, 8, 9 or 10 or any sub-range in between these, e.g. 5 to 7, 7 to 10 etc. Where a non-integer range is given then the range is intended to cover all numbers between, including the terminal numbers, with half the least significant figure being the step between numbers, e.g. a range of 10.5 to 11.2 specifically includes 10.50, 10.55, 10.6, 10.65, 10.70, 10.75, 10.8, 10.85, 10.9, 10.95, 11, 11.05, 11.1, 11.15, 11.2.

The invention claimed is:

1. A percussion device including an input side and an output side, where the input side is configured to be rotationally driven and the output side is configured to be rotationally driven by the input side via a drive transmitter/drive transmitter pathway combination, where at least one drive transmitter is configured to slide or roll along at least part of a length of a drive transmitter pathway, such that the percussion device further includes a percussion impactor, an impactor shaft and a percussion anvil wherein:

the impactor shaft is an elongate member extending from the output side towards the input side;

the percussion impactor includes impactor shaft tunnel which is a longitudinally co-axially aligned void;

the impactor shaft is a longitudinal sliding fit within the impactor shaft tunnel;

the impactor shaft incorporates one or more impactor shaft spline which is a longitudinally aligned helical spline;

the impactor shaft tunnel incorporates one or more impactor spline channel which is a longitudinally aligned helical channel in a wall of said impactor shaft tunnel; and the impactor shaft and percussion anvil are part of the output side;

such that in use, where the output side has restricted, or no, ability to rotate, the combination of the drive transmitter/drive transmitter pathway combination increases the distance between the percussion impactor and the percussion anvil as the interaction of the at least one impactor shaft spline within the complementary impactor spline channel causes the percussion impactor to rotate in a direction counter to the input side until the drive transmitter/drive transmitter pathway combination releases the percussion impactor, characterized in that, the percussion impactor includes at least one impactor impact tooth and the percussion anvil includes at least one anvil impact tooth, wherein each impact tooth includes an angled impact surface, such that complementary impact surfaces are configured to pass a percussive and/or rotational impulse from the percussion impactor to the percussion anvil.

2. The percussion device as claimed in claim 1 wherein, the helical twist in the impactor shaft spline is between $1/20^{th}$ and ¾ of a turn.

3. The percussion device as claimed in claim 2 wherein, the helical twist in the impactor shaft spline is between $1/6^{th}$ and ½ of a turn.

4. The percussion device as claimed in claim 1 wherein, the angle between the at least one impactor shaft spline and the impact surface is angle φ.

5. The percussion device as claimed in claim 4 wherein, the angle φ is between 65° and 135°.

6. The percussion device as claimed in claim 4 wherein, the angle φ is between 80° and 105°.

7. The percussion device as claimed in claim 4 wherein, the angle φ is between 85° and 105°.

8. The percussion device as claimed in claim 1 wherein, the impact surface on the at least one anvil tooth is an anvil impact surface and the impact surface on the at least one impactor impact tooth is an impactor impact surface.

9. The percussion device as claimed in claim 1 wherein, complementary impact surfaces are parallel +/−10° to each other.

10. The percussion device as claimed in claim 9 wherein, complementary impact surfaces are parallel +/−1° to each other.

11. The percussion device as claimed in claim 1 wherein, the impactor shaft tunnel is made up of a plurality of impactor shaft modules within a module tunnel formed within the percussion impactor.

12. The percussion device as claimed in claim 11 wherein, each impactor shaft module includes one or more module keys configured to engage with a module keyway within the module tunnel.

13. The percussion device as claimed in claim 11 wherein, the plurality of impactor shaft modules are held in the module tunnel by a retention device.

14. The percussion device as claimed in claim 11 wherein, each impactor shaft module is independently held within the module tunnel by a separate retention device.

15. The percussion impactor as claimed in claim 1 wherein, at least one drive transmitter incorporates a magnet, a transmitter magnet, and said at least one drive transmitter pathway includes at least one magnet, a pathway magnet, such that like poles of the magnets are facing, the strength of the magnets is selected so that in normal use the drive transmitter is physically separated from the drive transmitter pathway by a magnetic biasing force between opposing magnets.

16. The percussion impactor as claimed in claim 15 wherein, there are a plurality of pathway magnets spaced along a length of the drive transmitter pathway and the distance between the drive transmitter pathway and a terminal end, a force input end, of the impactor changes as you move along the length of the drive transmitter pathway.

17. The percussion impactor as claimed in claim 15 wherein, there are a plurality of pathway magnets spaced along a length of the transmitter pathway and the distance between the drive transmitter pathway and a terminal end of the impactor does not change as you move along the length of the transmitter pathway.

18. The percussion impactor as claimed in claim 15 wherein, at least one of the pathway magnets is embedded in a surface of the drive transmitter pathway.

19. The percussion impactor as claimed in claim 15 wherein, at least some of the plurality of pathway magnets are tuned pathway magnets; where each tuned pathway magnet has an independently selected magnetic field strength, such that the magnetic field strength is selected to form at least a portion of the drive transmitter pathway without changing the physical distance between the tuned pathway magnets and the force input end of the impactor.

20. The percussion impactor as claimed in claim 1 wherein, the impactor includes a splined tunnel module and the impact shaft includes a splined sleeve, where the splined tunnel module includes the impactor shaft tunnel and the splined sleeve includes the at least one impactor shaft spline; such that the splined tunnel module is releasably but rigidly retained in the impactor and the splined sleeve is releasably but rigidly attached to an impactor shaft core which is part of the output side; said splined tunnel module and splined sleeve form a changeable splined module set.

* * * * *